US011574624B1

(12) United States Patent
Joly et al.

(10) Patent No.: US 11,574,624 B1
(45) Date of Patent: Feb. 7, 2023

(54) SYNTHETIC SPEECH PROCESSING

(71) Applicant: Amazon Technologies, Inc., Seattle, WA (US)

(72) Inventors: Arnaud Vincent Pierre Yves Joly, Cambridge (GB); Panagiota Karanasou, Cambridge (GB); Alexis Pierre Jean-Baptiste Moinet, Cambridge (GB); Thomas Renaud Drugman, Carnieres (BE); Sri Vishnu Kumar Karlapati, Cambridge (GB); Syed Ammar Abbas, Cambridge (GB); Simon Slangen, Edinburgh (GB)

(73) Assignee: Amazon Technologies, Inc., Seattle, WA (US)

( * ) Notice: Subject to any disclaimer, the term of this patent is extended or adjusted under 35 U.S.C. 154(b) by 63 days.

(21) Appl. No.: 17/218,466

(22) Filed: Mar. 31, 2021

(51) Int. Cl.

| | |
|---|---|
| ***G10L 13/08*** | (2013.01) |
| ***G10L 13/07*** | (2013.01) |
| ***G10L 13/06*** | (2013.01) |
| ***G10L 25/30*** | (2013.01) |
| ***G10L 13/10*** | (2013.01) |
| ***G10L 13/047*** | (2013.01) |

(52) U.S. Cl.
CPC ..... *G10L 13/10* (2013.01); *G10L 13/047* (2013.01)

(58) Field of Classification Search
CPC ..... G10L 13/06; G10L 13/07; G10L 13/08; G10L 25/30
See application file for complete search history.

(56) References Cited

U.S. PATENT DOCUMENTS 10,741,169 B1 * 8/2020 Trueba ..... G10L 13/10
2018/0336880 A1 * 11/2018 Arik ..... G10L 15/063

FOREIGN PATENT DOCUMENTS

| | | | | |
|---|---|---|---|---|
| CN | 112352275 A | * | 2/2021 | ..... G06F 40/20 |
| CN | 112489618 A | * | 3/2021 | ..... G06N 3/0445 |
| CN | 112542155 A | * | 3/2021 | ..... G10L 25/30 |
| CN | 112786007 A | * | 5/2021 | ..... G10L 13/0335 |
| CN | 112951198 A | * | 6/2021 | ..... G10H 1/06 |
| GB | 2603776 A | * | 8/2022 | ..... G10L 13/033 |
| KR | 20220027598 A | * | 8/2020 | ..... G10L 13/08 |
| KR | 102287499 B1 | * | 8/2021 | ..... G10L 15/16 |

OTHER PUBLICATIONS

Vaswani, et al., "Attention is All You Need," In 31st Conference on Neural Information Processing Systems (NeurIPS 2017), Long Beach, California, pp. 1-11.
Li, et al., "Neural Speech Synthesis with Transformer Network," arXiv preprint arXiv: 1809.08895, 2019, 8 pages.

(Continued)

*Primary Examiner* — Shreyans A Patel
(74) *Attorney, Agent, or Firm* — Pierce Atwood LLP

(57) ABSTRACT

A speech-processing system receives input data representing text. An input encoder processes the input data to determine first embedding data representing the text. A local attention encoder processes a subset of the first embedding data in accordance with a predicted size to determine second embedding data. An attention encoder processes the second embedding data to determine third embedding data. A decoder processes the third embedding data to determine audio data corresponding to the text.

20 Claims, 19 Drawing Sheets

(56) References Cited

OTHER PUBLICATIONS

Yang, et al., "Modeling Localness for Self-Attention Networks," In Proceedings of the 2018 Conference on Empirical Methods in Natural Language Processing (EMNLP), Brussels, Belgium, 2018, pp. 4449-4458.

Ren, et al., "FastSpeech: Fast, Robust and Controllable Text to Speech," In 33rd Conference on Neural Information Processing Systems (NeurIPS 2019), Vancouver, Canada, pp. 1-10.

* cited by examiner

Speech Synthesis Component 270g

Audio Data 318
Decoder 316
Duration Data 314
Upsamplling Encoder 312
Attention Encoder(s) 310
Local Attention Encoder(s) A 308a
Local Attention Encoder(s) B / Upsample 308b
Position Data A 304a
Position Data B 304b
Input Encoder A 306a
Input Encoder B 306b
Input Data A 302a
Input Data B 302b

SYNTHETIC SPEECH PROCESSING

BACKGROUND

A speech-processing system includes a speech-synthesis component for processing input data, such as text data, to determine output data that includes a representation of synthetic speech corresponding to the text data. The synthetic speech includes variations in prosody, such as variations in speech rate, emphasis, timbre, or pitch. The prosody of the speech may be learned by processing training audio data and then determined by processing the text data.

BRIEF DESCRIPTION OF DRAWINGS

For a more complete understanding of the present disclosure, reference is now made to the following description taken in conjunction with the accompanying drawings.

DETAILED DESCRIPTION

Figure 1:
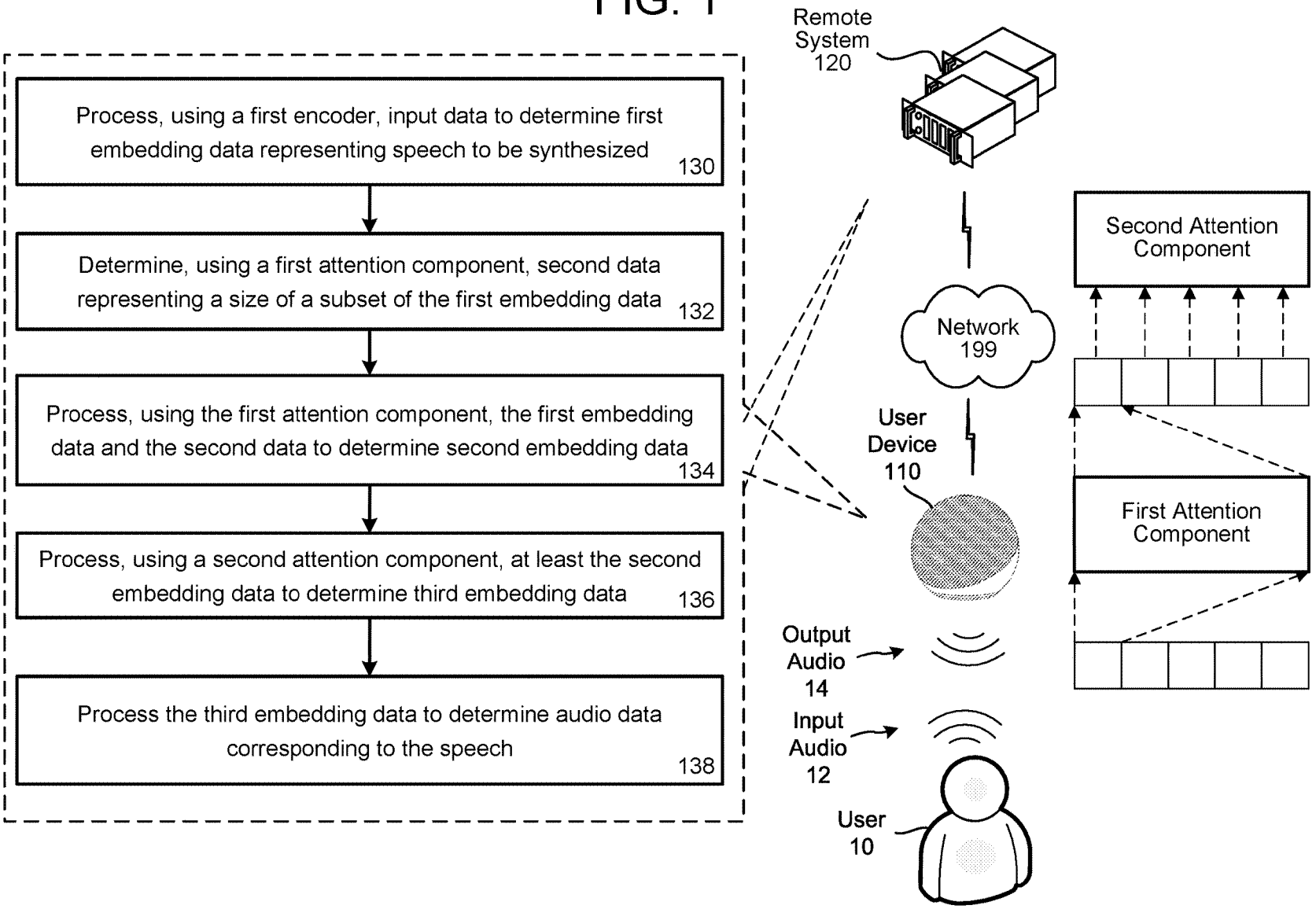
FIG. 1 illustrates a method for speech processing according to embodiments of the present disclosure.

Speech-processing systems may include one or more speech-synthesis components that employ one or more of various techniques to generate synthesized speech from input data (such as text data or other data representing words such as word identifiers, indices or other indicators of words, word embedding data, etc.). The speech-synthesis component may include an encoder for processing the text data and determining phoneme embedding data representing phonemes of the text data. The speech-synthesis component may also include a decoder for processing the phoneme encoded data and the predicted features to determine output data representing the synthesized speech.

Human speech may include natural variations known as prosody. As the term is used herein, "prosody" refers to the manner in which a given word, sentence, paragraph, or other unit of speech is spoken. Aspects of prosody may include the rate of the speech, the loudness of the speech, how syllables, words, or sentences in the speech are emphasized, when and where pauses in the speech may be inserted, or what emotion (e.g., happy, sad, or anxious) is expressed in the speech.

Aspects of the present disclosure thus relate to synthesizing speech that includes variations in prosody, such as speed and pitch, to better make the synthesized speech sound like human speech. A first type of additional encoder, referred to herein as a local-attention encoder (or local-attention transformer) processes the output of the prosody encoder to add "local" prosody, such as variations in prosody that correspond to a small group of words. In other words, while a transformer is configured to process multiple units of text in parallel (e.g., a transformer may process text corresponding to a sentenced in parallel), a local-attention transformer is configured to also consider local variations in prosody, such a as variations that occur across 3-5 words. A second type of additional encoder, referred to herein as an attention encoder (or transformer), processed the output of the local-attention encoder to add higher-level prosody, such as variations in prosody that change sentence-by-sentence. The speech decoder may then process the output of the attention encoder.

In various embodiments, the speech-processing system is disposed on a single device, such as a user device (e.g., Echo device, phone, tablet, Fire TV device, television, personal computer, etc.). In other embodiments, the speech-processing system is distributed across one or more user devices, such as a smartphone or other smart loudspeaker, and one or more remote systems, such as one or more server, storage, and/or computing machines. The user device may capture audio that includes a representation of human speech and then process the audio data itself and/or transmit the audio data representing the audio to the remote system for further processing. The user device may have, for example, a wakeword-determination component that detects presence of a wakeword in audio and transmits corresponding audio data to the remote system only when the wakeword is detected. As used herein, a "wakeword" is one or more particular words, such as "Alexa," "OK Google," or "Hey Siri," that a user of the user device may utter to cause the user device to begin processing subsequent audio data, which may further include a representation of a command, such as "tell me a funny story" or "read me the news."

The user device and/or remote system may include an automatic speech-recognition (ASR) component that processes the audio data to determine corresponding text data and a natural-language understanding (NLU) component that processes the text data to determine the intent of the user expressed in the text data and thereby determine an appropriate response to the intent. Determination of the response may include processing output of the NLU component using the speech-synthesis component, also referred to as a text-to-speech (TTS) processing component, to determine audio data representing the response. The user device may determine the response using a speech-synthesis component of the user device or the remote system may determine the response using a speech-synthesis component of the remote system and transmit data representing the response to the user device (or other device), which may then output the response. In other embodiments, a user of a user device may wish to transmit audio data for reasons other than ASR/NLU processing, such as one- or two-way audio communication with one or more other user devices or remote systems.

Referring to FIG. 1, a user 10 may provide input data, such as input audio 12, to a voice-controlled user device 110 or a display-enabled user device (e.g., a device featuring at least one display 816, such as a smartphone, tablet, or personal computer). The input data may include one or more user gestures directed to the user device, such as a touch-screen input, mouse click, or key press. The input data may further be or include input audio 12. The user device 110 may output audio 14 that may include a representation of synthesized speech responsive to input audio 12.

The user device 110 may, in some embodiments, receive the input audio 12 and may transduce it (using, e.g., a microphone) into corresponding audio data. As explained in further detail herein, the user device 110 may perform additional speech processing or may send the audio data to a remote system 120 for further audio processing via a network 199. Regardless of whether it is performed by the user device 110 and/or the remote system 120, an ASR component may process the audio data to determine corresponding text data, and an NLU component may process the text data to determine NLU data such as a domain, intent, or entity associated with the text data.

In various embodiments, the user device 110 and/or remote system 120 receives text data representing words. The words may represent a response to a user command corresponding to the input audio 12, a news story, a book, an article in a newspaper or a magazine, or any other such input data representing words. The input data may directly represent words of the text, such as ACSII data representing the words, or may be a representation of sub-word or sub-syllable sounds (herein referred to as "phonemes") representing the words. The input data may further include metadata corresponding to the text, such as locations of word boundaries, sentence boundaries, or paragraph boundaries.

The user device 110 and/or the remote system 120 processes (130), using a first encoder (e.g., the input encoder 306 of FIG. 3A), input data to determine first embedding data representing speech to be synthesized. In other words, the first encoder determines a point in an embedding space, as represented by the first embedding data, that represents the first data.

The user device 110 and/or the remote system 120 determines (132), using a first attention component, second data representing a size of a subset of the first embedding data, wherein "size" referrers to a number of phonemes and/or corresponding embedding data and wherein "subset" refers to which particular phonemes and/or corresponding embedding data. As explained in greater detail below, the first attention component may be a local-attention encoder (also known as a local-attention transformer) that predicts a size and position of a window, as represented by a Gaussian distribution, that corresponds to a given item or items of input data, such as a given phoneme or word. The size of the window determines which other items adjacent to the given item (the "subset") should be given more and/or different attention. The user device 110 and/or the remote system 120 processes (134), using the first attention component, the first embedding data and the second data to determine second embedding data. As explained in greater detail below, the first attention component may combine the determined Gaussian with determined attention data to determine the second embedding data.

The user device 110 and/or the remote system 120 processes (136), using a second attention component (e.g., an attention encoder or self-attention component), at least the second embedding data to determine third embedding data. This second attention component does not determine a subset and thus processes all of the items input to it; in other words the second attention component has a greater scope with respect to the input than does the first attention component. The user device 110 and/or the remote system 120 processes (138), the third embedding data (using, e.g., a decoder) to determine audio data corresponding to the speech. The audio data output by the decoder may include Mel-spectrograms; this audio data may be further processed by a vocoder to determine an audio waveform.

Figure 2A:
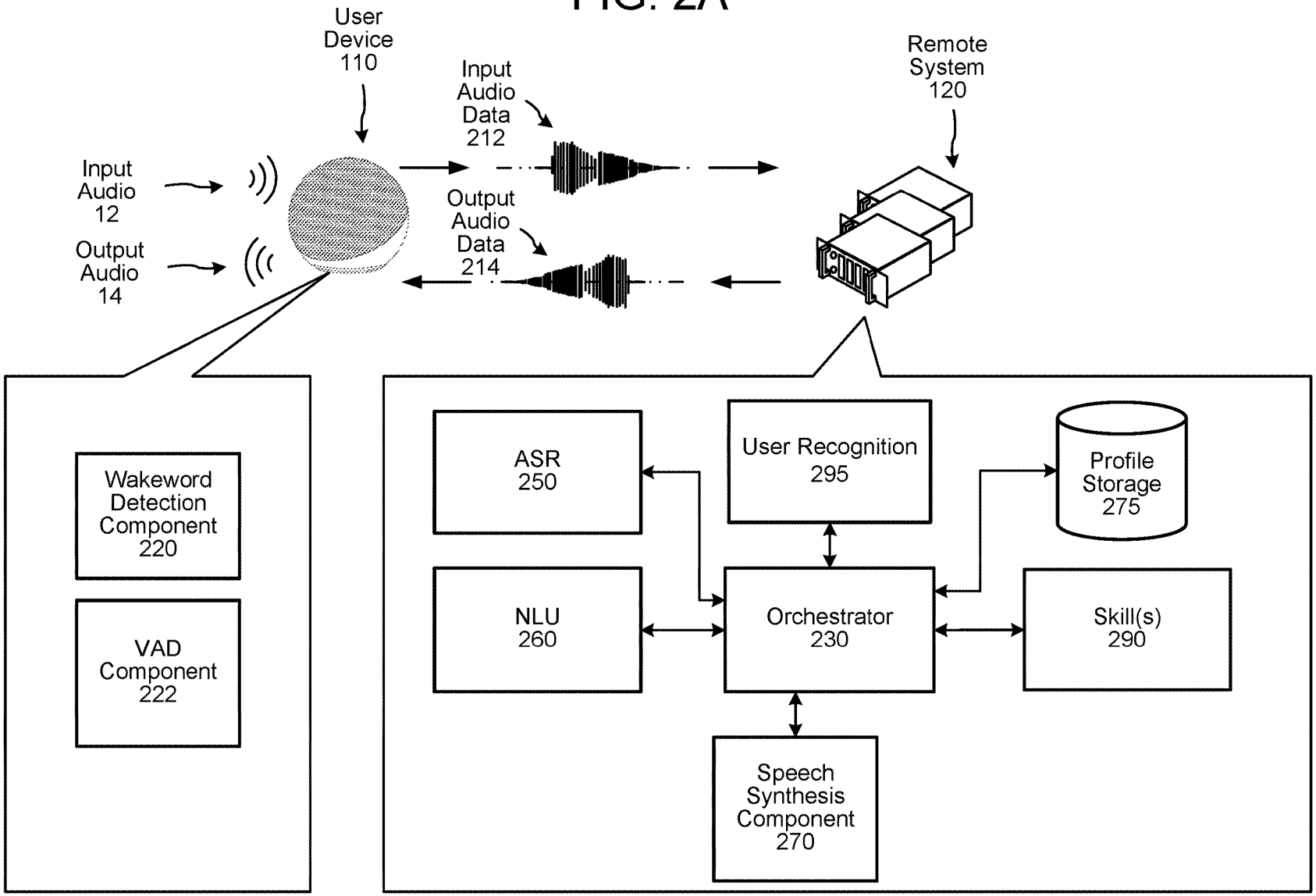
FIG. 2A illustrates components of a user device and of a remote system for speech processing according to embodiments of the present disclosure.
Figure 2B:
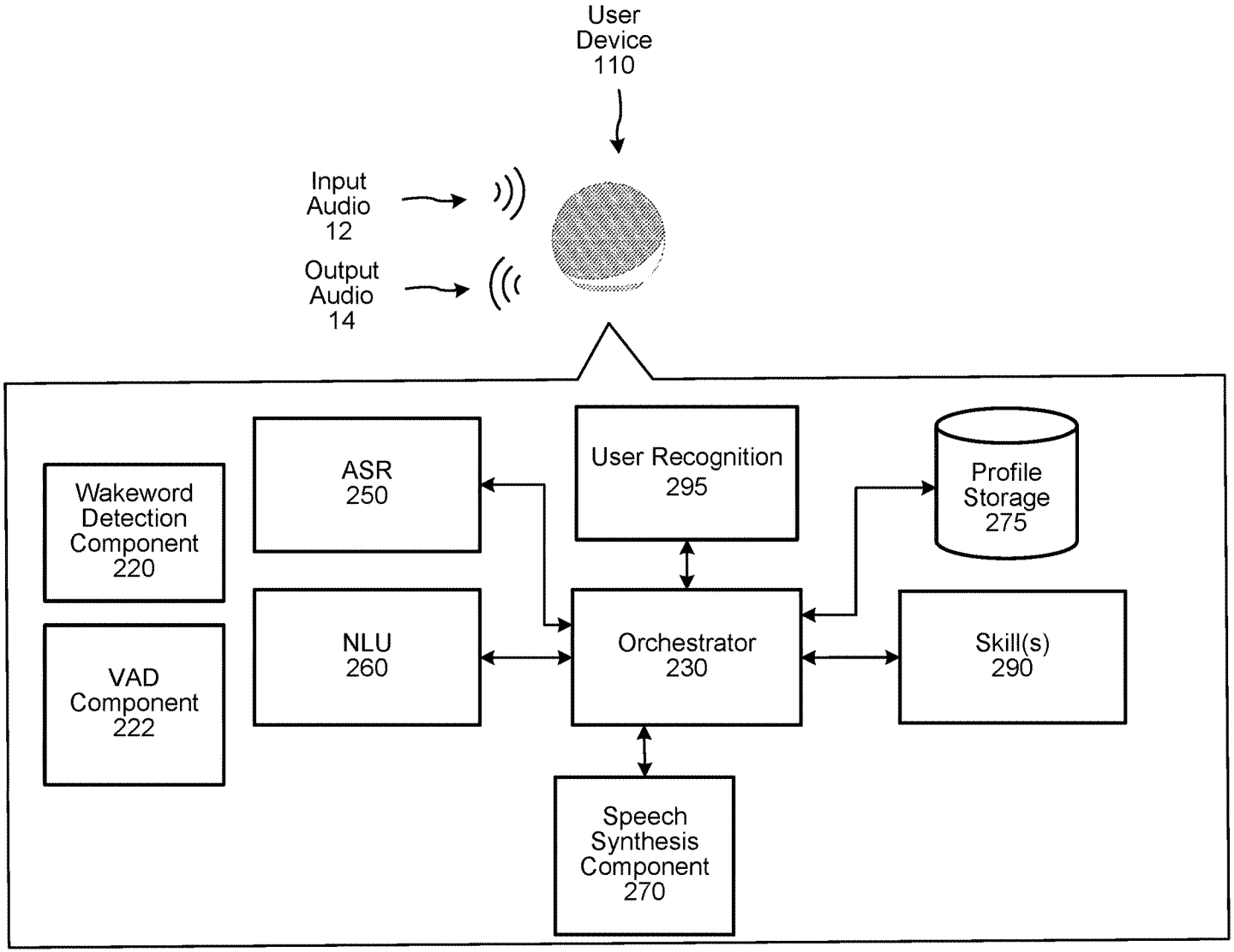
FIG. 2B illustrates components of a user device for speech processing according to embodiments of the present disclosure.

Referring to FIGS. 2A and 2B, a speech-synthesis component 270 may process input text data 274 to determine output audio data representing synthesized speech corresponding to the input text data. The speech-synthesis component 270 may process training data (e.g., audio data representing speech and text data corresponding to the speech) to train the speech-synthesis component 270. Embodiments of the speech-synthesis component 270 are described in greater detail herein.

Referring to FIG. 2A, the user device 110 may capture input audio 12 that includes speech and then either process the audio itself or transmit audio data 212 representing the audio 12 to the remote system 120 for further processing. The user device 110 may include a wakeword-determination component 220 that detects presence of a wakeword in audio and transmits corresponding audio data to the remote system only when (or after) the wakeword is detected. As used herein, a "wakeword" is one or more particular words, such as "Alexa," that a user of the user device may utter to cause the user device to begin processing the audio data, which may further include a representation of a command, such as "turn on the lights."

Referring also to FIG. 2B, the speech-processing system, including the speech-synthesis component 270, may disposed wholly on the user device 110. In other embodiments, some additional components, such as an ASR component, are disposed on the user device 110, while other components are disposed on the remote system 120. Any distribution of the components of the speech-processing system of the present disclosure is, thus, within the scope of the present disclosure. The discussion herein thus pertains to both the distribution of components of FIGS. 2A and 2B and also to similar distributions.

The user device 110 or remote system 120 may further include an automatic speech-recognition (ASR) component that processes the audio data to determine corresponding text data and a natural-language understanding (NLU) component that processes the text data to determine the intent of the user expressed in the text data and thereby determine an appropriate response to the intent; the response may include th the input text data 274. The remote system 120 may determine and transmit data representing the response, which may include the output audio data 214, to the user device 110 (or other device), which may then output the response.

Before processing the audio data, the user device 110 may use various techniques to first determine whether the audio data includes a representation of an utterance of the user 10. For example, the user device 110 may use a voice-activity detection (VAD) component 222 to determine whether speech is represented in the audio data based on various quantitative aspects of the audio data, such as the spectral slope between one or more frames of the audio data, the energy levels of the audio data in one or more spectral bands the signal-to-noise ratios of the audio data in one or more spectral bands or other quantitative aspects. In other examples, the VAD component 222 may be a trained classifier configured to distinguish speech from background noise. The classifier may be a linear classifier, support vector machine, or decision tree. In still other examples, hidden Markov model (HMM) or Gaussian mixture model (GMM)

techniques may be applied to compare the audio data to one or more acoustic models in speech storage; the acoustic models may include models corresponding to speech, noise (e.g., environmental noise or background noise), or silence.

If the VAD component 222 is being used and it determines the audio data includes speech, the wakeword-detection component 220 may only then activate to process the audio data to determine if a wakeword is likely represented therein. In other embodiments, the wakeword-detection component 220 may continually process the audio data (in, e.g., a system that does not include a VAD component.) The user device 110 may further include an ASR component for determining text data corresponding to speech represented in the input audio 12 and may send this text data to the remote system 120.

The trained model(s) of the VAD component 222 or wakeword-detection component 220 may be CNNs, RNNs, acoustic models, hidden Markov models (HMMs), or classifiers. These trained models may apply general large-vocabulary continuous speech recognition (LVCSR) systems to decode the audio signals, with wakeword searching conducted in the resulting lattices or confusion networks. Another approach for wakeword detection builds HMMs for each key wakeword word and non-wakeword speech signals respectively. The non-wakeword speech includes other spoken words, background noise, etc. There may be one or more HMMs built to model the non-wakeword speech characteristics, which may be referred to as filler models. Viterbi decoding may be used to search the best path in the decoding graph, and the decoding output is further processed to make the decision on wakeword presence. This approach can be extended to include discriminative information by incorporating a hybrid DNN-HMM decoding framework. In another example, the wakeword-detection component may use convolutional neural network (CNN)/recursive neural network (RNN) structures directly, without using a HMM. The wakeword-detection component may estimate the posteriors of wakewords with context information, either by stacking frames within a context window for a DNN, or using a RNN. Follow-on posterior threshold tuning or smoothing may be applied for decision making.

The remote system 120 may be used for additional audio processing after the user device 110 detects the wakeword or speech, potentially begins processing the audio data with ASR or NLU, or sends corresponding audio data 212. The remote system 120 may, in some circumstances, receive the audio data 212 from the user device 110 (or other devices or systems) and perform speech processing thereon. Each of the components illustrated in FIGS. 2A and 2B may thus be disposed on either the user device 110 or the remote system 120. The remote system 120 may be disposed in a location different from that of the user device 110 (e.g., a cloud server) or may be disposed in the same location as the user device 110 (e.g., a local hub server).

The audio data 212 may be sent to, for example, an orchestrator component 230 of the remote system 120. The orchestrator component 230 may include memory and logic that enables the orchestrator component 230 to transmit various pieces and forms of data to various components of the system 120. An ASR component 250, for example, may first transcribe the audio data into text data representing one more hypotheses corresponding to speech represented in the audio data 212. The ASR component 250 may transcribe the utterance in the audio data based on a similarity between the utterance and pre-established language models. For example, the ASR component 250 may compare the audio data with models for sounds (which may include, e.g., subword units, such as phonemes) and sequences of sounds represented in the audio data to identify words that match the sequence of sounds spoken in the utterance. These models may include, for example, one or more finite state transducers (FSTs). An FST may include a number of nodes connected by paths. The ASR component 250 may select a first node of the FST based on a similarity between it and a first subword unit of the audio data. The ASR component 250 may thereafter transition to second and subsequent nodes of the FST based on a similarity between subsequent subword units and based on a likelihood that a second subword unit follows a first.

After determining the text data, the ASR component 250 may send (either directly or via the orchestrator component 230) the text data to a corresponding NLU component 260. The text data output by the ASR component 250 may include a top-scoring hypothesis or may include an N-best list including multiple hypotheses (e.g., a list of ranked possible interpretations of text data that represents the audio data). The N-best list may additionally include a score associated with each hypothesis represented therein. Each score may indicate a confidence of ASR processing performed to generate the hypothesis with which it is associated.

The NLU component 260 may process the text data to determine a semantic interpretation of the words represented in the text data. That is, the NLU component 260 determines one or more meanings associated with the words represented in the text data based on individual words represented in the text data. The meanings may include a domain, an intent, and one or more entities. As those terms are used herein, a domain represents a general category associated with the command, such as "music" or "weather." An intent represents a type of the command, such as "play a song" or "tell me the forecast for tomorrow." An entity represents a specific person, place, or thing associated with the command, such as "Toto" or "Boston." The present disclosure is not, however, limited to only these categories associated with the meanings (referred to generally herein as "natural-understanding data," which may include data determined by the NLU component 260 or the dialog manager component.)

The NLU component 260 may determine an intent (e.g., an action that the user desires the user device 110 or remote system 120 to perform) represented by the text data or pertinent pieces of information in the text data that allow a device (e.g., the device 110, the system 120, etc.) to execute the intent. For example, if the text data corresponds to "play Africa by Toto," the NLU component 260 may determine that a user intended the system to output the song Africa performed by the band Toto, which the NLU component 260 determines is represented by a "play music" intent. The NLU component 260 may further process the speaker identifier 214 to determine the intent or output. For example, if the text data corresponds to "play my favorite Toto song," and if the identifier corresponds to "Speaker A," the NLU component may determine that the favorite Toto song of Speaker A is "Africa."

The user device 110 or remote system 120 may include one or more skills 290. A skill 290 may be software such as an application. That is, the skill 290 may enable the user device 110 or remote system 120 to execute specific functionality in order to provide data or produce some other output requested by the user 10. The user device 110 or remote system 120 may be configured with more than one skill 290.

In some instances, a skill 290 may provide text data, such as the input text data, responsive to received NLU results data. The device 110 or system 120 may include the speech-synthesis component 270 that generates output audio data from input data, such as text data. The speech-synthesis component 270 may use one of a variety of speech-synthesis techniques. In one method of synthesis called unit selection, the speech-synthesis component 270 analyzes text data against a database of recorded speech. The speech-synthesis component 270 selects units of recorded speech matching the text data and concatenates the units together to form output audio data. In another method of synthesis called parametric synthesis, the speech-synthesis component 270 varies parameters such as frequency, volume, and noise to create output audio data including an artificial speech waveform. Parametric synthesis uses a computerized voice generator, sometimes called a vocoder. In another method of speech synthesis, a trained model directly generates output audio data based on the input text data, as shown in FIGS. 3A-3G.

The user device 110 and/or remote system 120 may include a speaker-recognition component 295. The speaker-recognition component 295 may determine scores indicating whether the audio data 212 originated from a particular user or speaker. For example, a first score may indicate a likelihood that the audio data 212 is associated with a first synthesized voice and a second score may indicate a likelihood that the speech is associated with a second synthesized voice. The speaker recognition component 295 may also determine an overall confidence regarding the accuracy of speaker recognition operations. The speaker recognition component 295 may perform speaker recognition by comparing the audio data 212 to stored audio characteristics of other synthesized speech. Output of the speaker-recognition component 295 may be used to inform NLU processing as well as processing performed by the skill 290.

The user device 110 or remote system 120 may include a profile storage 275. The profile storage 275 may include a variety of information related to individual users or groups of users who interact with the device 110. The profile storage 275 may similarly include information related to individual speakers or groups of speakers that are not necessarily associated with a user account.

Each profile may be associated with a different user or speaker. A profile may be specific to one user or speaker or a group of users or speakers. For example, a profile may be a "household" profile that encompasses profiles associated with multiple users or speakers of a single household. A profile may include preferences shared by all the profiles encompassed thereby. Each profile encompassed under a single profile may include preferences specific to the user or speaker associated therewith. That is, each profile may include preferences unique from one or more user profiles encompassed by the same user profile. A profile may be a stand-alone profile or may be encompassed under another user profile. As illustrated, the profile storage 275 is implemented as part of the remote system 120. The profile storage 275 may, however, may be disposed on the user device 110 or in a different system in communication with the user device 110 or system 120, for example over the network 199. The profile data may be used to inform speech processing.

Each profile may include information indicating various devices, output capabilities of each of the various devices, or a location of each of the various devices 110. This device-profile data represents a profile specific to a device. For example, device-profile data may represent various profiles that are associated with the device 110, speech processing that was performed with respect to audio data received from the device 110, instances when the device 110 detected a wakeword, etc. In contrast, user- or speaker-profile data represents a profile specific to a user or speaker.

FIGS. 3A-3G illustrates components of speech-synthesis components 270 according to embodiments of the present disclosure. As described above, the speech-synthesis component(s) 270 process input data 302 to determine audio data 318. The input data 302 may be text data that represents speech or other data that represents speech; the audio data 318 may include a representation of synthesized speech corresponding to the input data 302.

The input data 302 may be a representation of text, such as ASCII text data, that represents words, sentences, chapters, or other units of text. As mentioned above, the input data 302 may be determined by a speech app or skill. The input data 302 may instead or in addition be phoneme data. A phoneme determination component, such as an acoustic model, may process the text data to determine the phoneme data. The phoneme data may represent syllable-level or sub-syllable level units that corresponds to portions of words in the input data 302. The phoneme determination component may be a trained model, such as an acoustic model, that processes input text to determine corresponding phonemes.

Figure 3A:
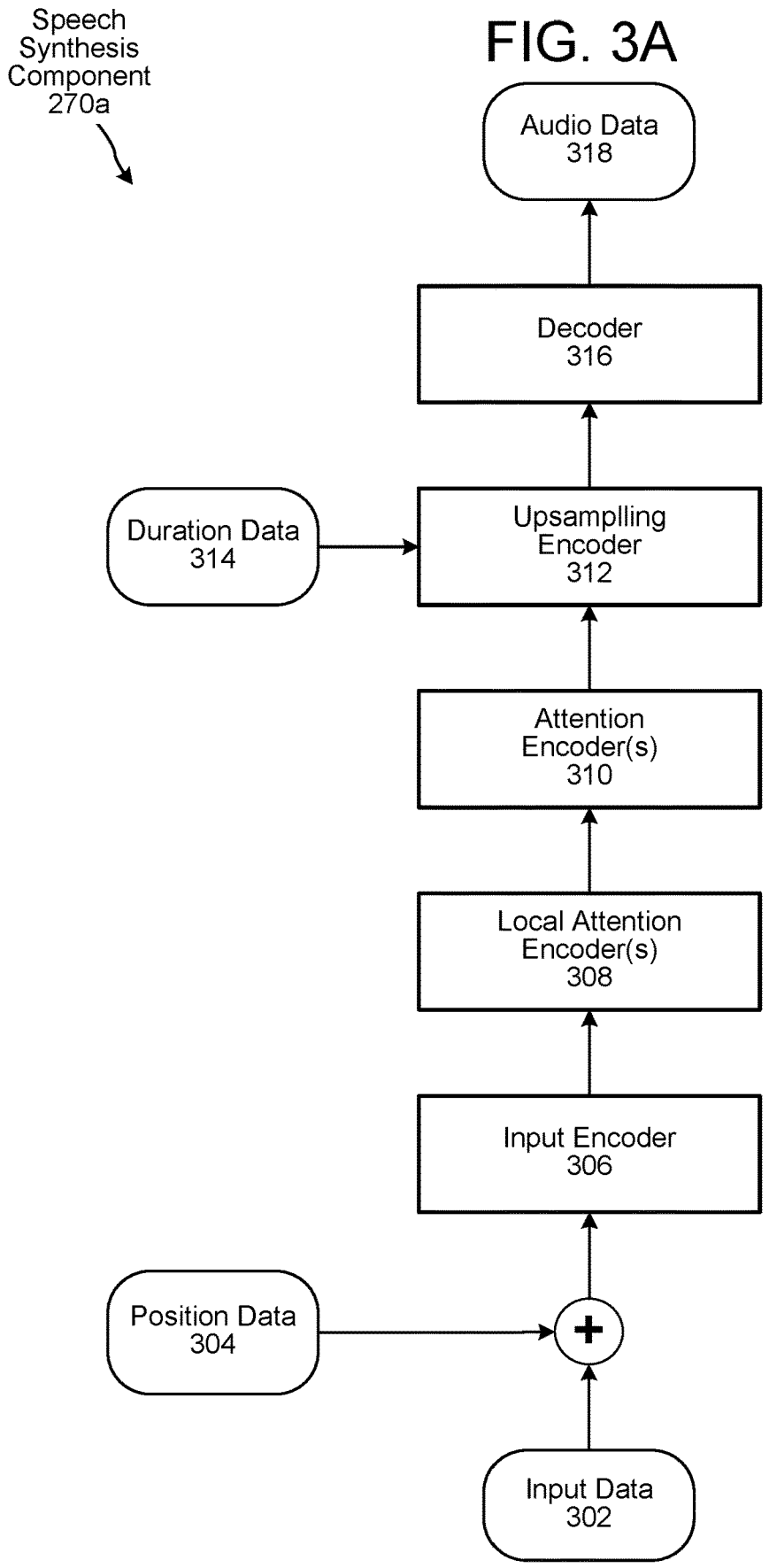
FIGS. 3A-3G illustrate components for synthesizing audio data using a speech-synthesis component according to embodiments of the present disclosure.

Referring first to FIG. 3A, an input encoder 306 (described in greater detail below with respect to FIG. 7A) may process the input data 302 to determine first embedding data. The input encoder 306 may process items of input data 302 in series to determine the first embedding data, each item of which may represent an item of input data 302*a* and zero or more items of previously processed input data 302. For example, if the input data 302 corresponds to a sentence, the input encoder 306 may process each word of the sentence (or each phoneme of each word of the sentence) in series. The input encoder 306 may include feed-forward layers (e.g., the first embedding data may correspond to a simple embedding) and/or convolutional layers (e.g., the first embedding data may correspond to a convolutional embedding).

The first embedding data may include a number of N-bit vectors (such as 32-bit vectors) that represent one or more phonemes, words, sentences, or other units of text in the input data 302. For example, a first sentence in the input data 302 may correspond to a first item of first embedding data that uniquely identifies that sentence, while a second sentence in the input data 302 may correspond to a second item of first embedding data that uniquely identifies that sentence, and so on. The first embedding data may thus correspond to a point in an embedding space corresponding to the input data 302, wherein the embedding space is an N-dimensional space representing all possible words, sentences, paragraphs, chapters, or books. Points near each other in the embedding space may represent similar items of input data 302, while points far from each other in the embedding space may represent dissimilar items of input data 302.

The input data 302 may be combined with position data 304 prior to processing by the input encoder 306. In various embodiments, other components of the speech-synthesis component 270*a*, such as the local attention encoder 308 and/or the attention encoder 310, may process data in parallel; the data processed by these components may lack an indication of where each item of input data 302 is positioned relative to other items of input data 302. The position data 304 may thus indicate this position, and each item of input data 302 may be associated with its relative position. For example, the position data 304 may include a number "1" to be associated with a first phoneme of the input data 302, a number "2" to be associated with a second phoneme of the input data 302, and so on. The speech-synthesis component 270*a* may, for example, include a counter for counting the number of items of input data 302 as they are processed to thereby generate the position data 304. Any method of indicating position and any method of representing the position data 304 is, however, within the scope of the present disclosure.

Figure 4:
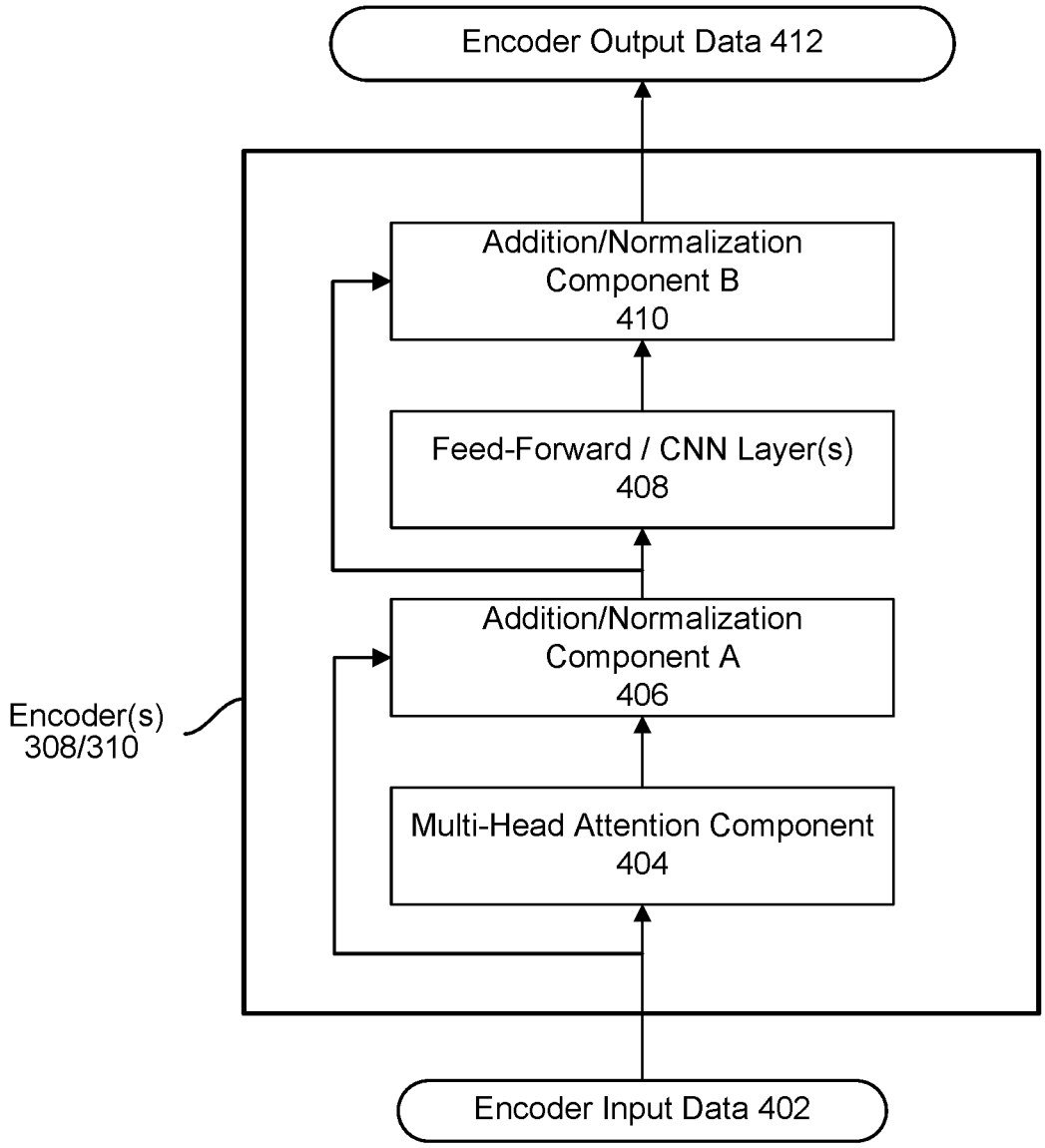
FIG. 4 illustrates components of a first encoder according to embodiments of the present disclosure.

A local attention encoder 308, which may also be referred to as a transformer, may process the first embedding data to determine second embedding data. The local attention encoder 308, embodiments of which are shown in FIGS. 4 and 5B, may include may include an attention component (which may be a multi-head attention component), one or more feed-forward and/or convolutional layers, and/or other components. As explained in greater detail below with respect to FIG. 5B, the local attention encoder 308 may determine a size of a subset of the first embedding data by, for example, predicting a width of a Gaussian distribution corresponding to an item of the first embedding data. This distribution may represent more emphasis, or attention, paid to a certain number of adjacent items. The local attention encoder 308 may then process the first embedding data in accordance with the size of the subset to determine the second embedding data; the second embedding data may represent greater attention to items in the subset.

An attention encoder 310 may process the second embedding data determined by the local attention encoder 308 to determine third embedding data. The attention encoder 310 may process the entirety of the second embedding data; e.g., it may not predict and process only a subset. Embodiments of the attention encoder 310 are explained in greater detail with respect to FIGS. 4 and 5A. The attention encoder 310 may similarly include an attention component (which may be a multi-head attention component), one or more feed-forward and/or convolutional layers, and/or other components.

A speech decoder 316 may then process the third embedding data to determine audio data 318, which may include one or more Mel-spectrograms corresponding to the input data 302; if the input data represents text, for example, the audio data 318 may include a representation of synthetic speech corresponding to the text. The speech decoder 316 is explained in greater detail below with reference to FIG. 7B. A vocoder may then process the audio data 318 to determine output audio data, which may be a time-domain representation of an audio waveform that corresponds to the input data 302.

In some embodiments, an upsampling encoder 312 processes the third embedding data determined by the attention encoder 310 in accordance with duration data 314 to determine upsampled third embedding data, which in turn is processed by the decoder 316 to determine the audio data 318. The upsampling encoder 312 may include a bi-directional long short-term memory (BiLSTM) layer. In various embodiments, the sample rate of the input data 302 (e.g., the number of items of input data 302 corresponding to a given duration of time) is less than the sample rate of the audio data 318 (e.g., the number of items of audio data 318 corresponding to the given duration of time). The upsampling encoder 312 may thus upsample, or duplicate, items of the third embedding data such that the sample rate of the third embedding data matches that of the audio data 318. The upsampling encoder 312 may interpolate between or average items of the third embedding data during the up sampling. The duration data 314 may indicate how much a given item of third embedding data should be upsampled. The duration data 314 may be determined by a trained model by processing the input data 302. This trained model may be trained by using data consisting of text data and corresponding audio data representing speech.

Figure 3B:
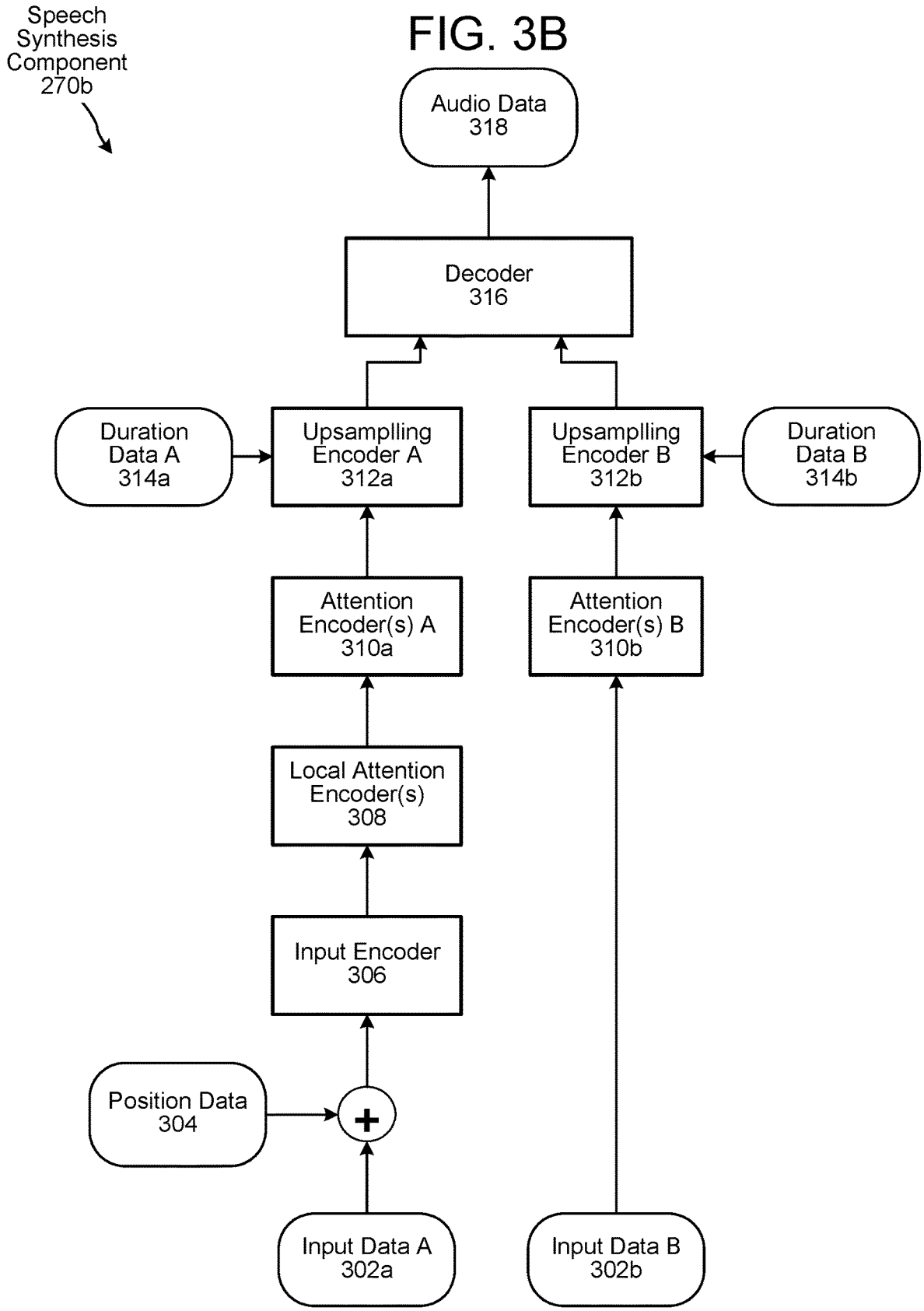

Referring to FIG. 3B, in various embodiments, a speech-synthesis component 270*b* may process multiple representations of input data, such as input data A 302*a* and input data B 302*b*. Input data A 302*a* may represent a first level of hierarchy of a representation of text or other data, and input data B 302*b* may represent a different level of hierarchy of the text or other data. For example, input data A 302*a* may correspond to phonemes representing text, and input data B 302*b* may correspond to words representing the text. Other examples of hierarchy include phrases, clauses, sentences, paragraphs, chapters, essays, and/or books. The input data 302 may further correspond to other types of context, such as mood and/or location of a user 10. The present disclosure is not limited to any particular type of input data 302. Further, though two types of input data 302*a*, 302*b* are illustrated, the speech-synthesis component 270*b* may process any number of types of input data 302, such as three or more types. For example, the speech-synthesis component 270*b* may process input data corresponding to phonemes, words, and sentences.

In various embodiments, input data A 302*a* and position data 304 are processed by an input encoder 306, a local attention encoder 308, an attention encoder 310*a*, an upsampling encoder 312*a* (in accordance with duration data A 314*a*), and a decoder 316 to determine audio data 318. The input data B 302*b* may have a lower sample rate than that of the input data A 302*a* (e.g., it corresponds to a higher level of hierarchy, such as phonemes for input data A 302*a* and words or input data B 302*b*). The input data B 302*b* may thus be processed only by an attention encoder 310*b* and an upsampling encoder 312*b* (in accordance with duration data B 314*b*). Like the speech-synthesis component 270*a* of FIG. 3A, the speech-synthesis component 270*b* is not limited to only two types of input data 302*a*, 302*b*.

Figure 3C:
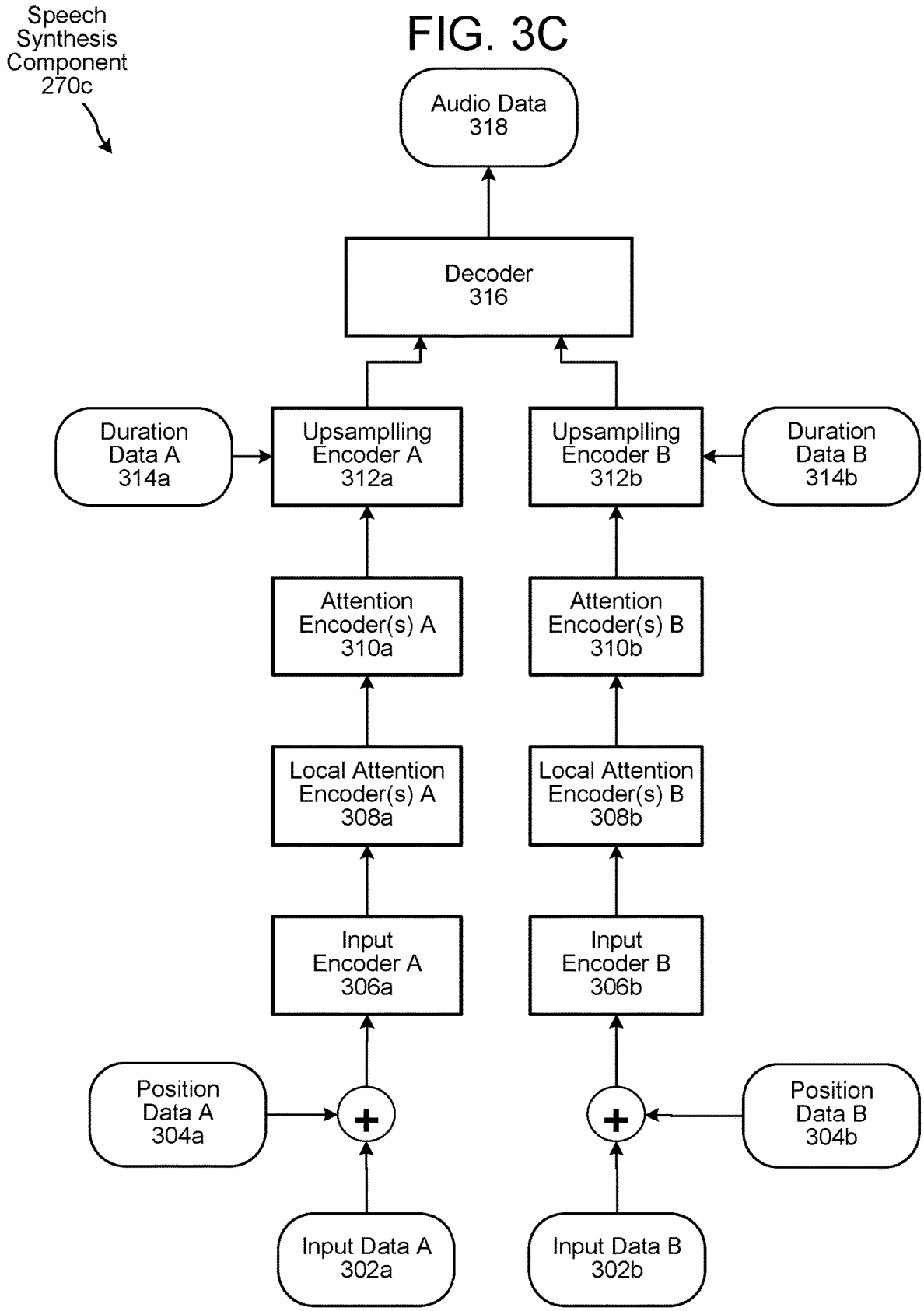

Referring to FIG. 3C, a speech-synthesis component 270*c* may, unlike the speech-synthesis component 270*b* of FIG. 3B, process the input data B 302*b* (and position data B 304*b*) using an input encoder 306*b* and local attention encoder B 308*b*. The rest of the components of the speech-synthesis component 270*c* may process data in accordance with similar components described above with reference to FIGS. 3A and 3B.

Figure 3D:
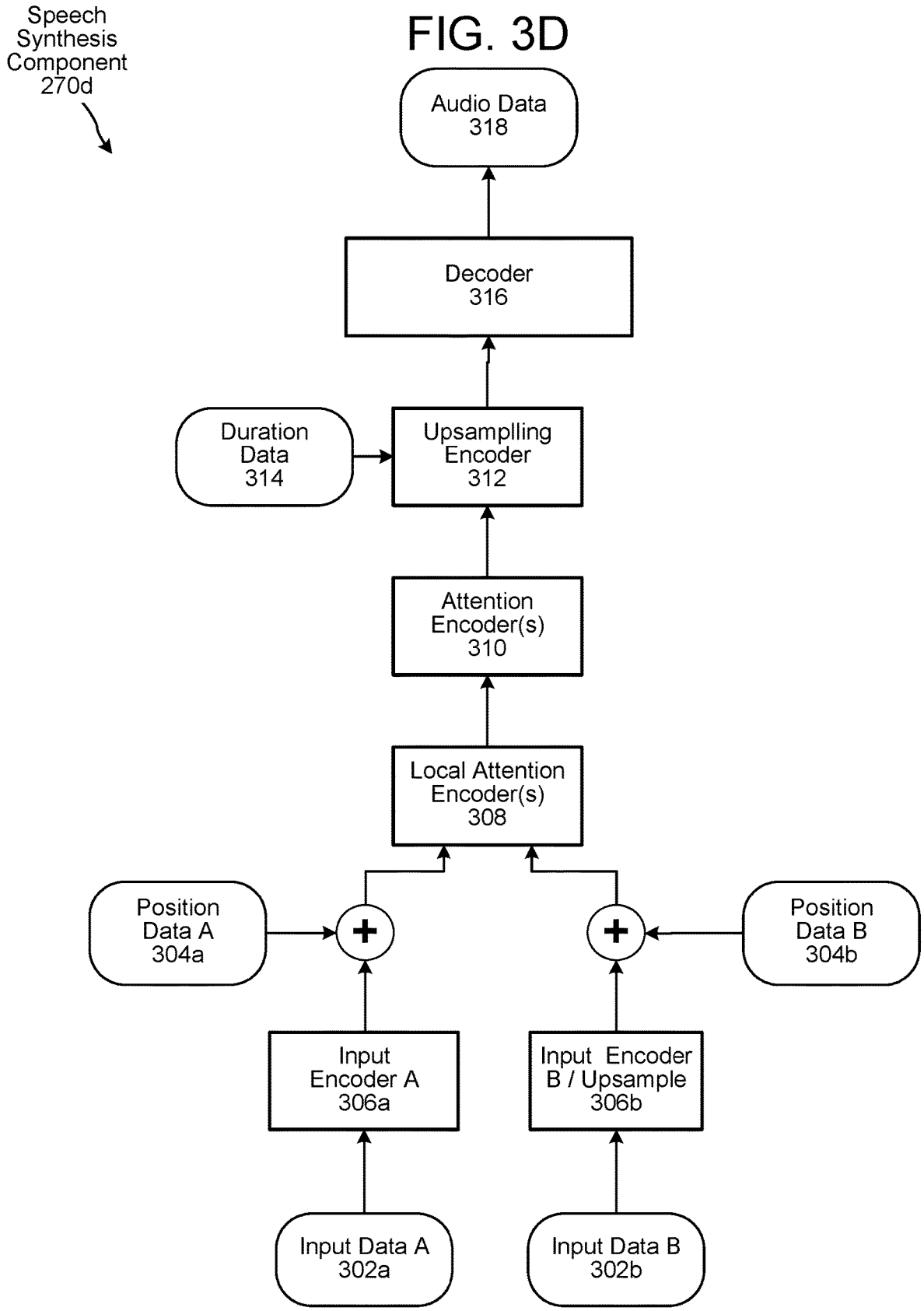

Referring to FIG. 3D, a speech-synthesis component 270*d* may include a single local attention encoder 308, which may process the output of an input encoder A 306*a* (as combined with position data A 304*a*) and the upsampled output of an input encoder B 306*b*. The output of the input encoder B 306*b* may be upsampled because input data B 302*b* has a lower sample rate (e.g., higher level of hierarchy) than that of input data A 302*a*. The remainder of the components may process data in accordance with similar components described above with reference to FIGS. 3A-3C.

Figure 3E:
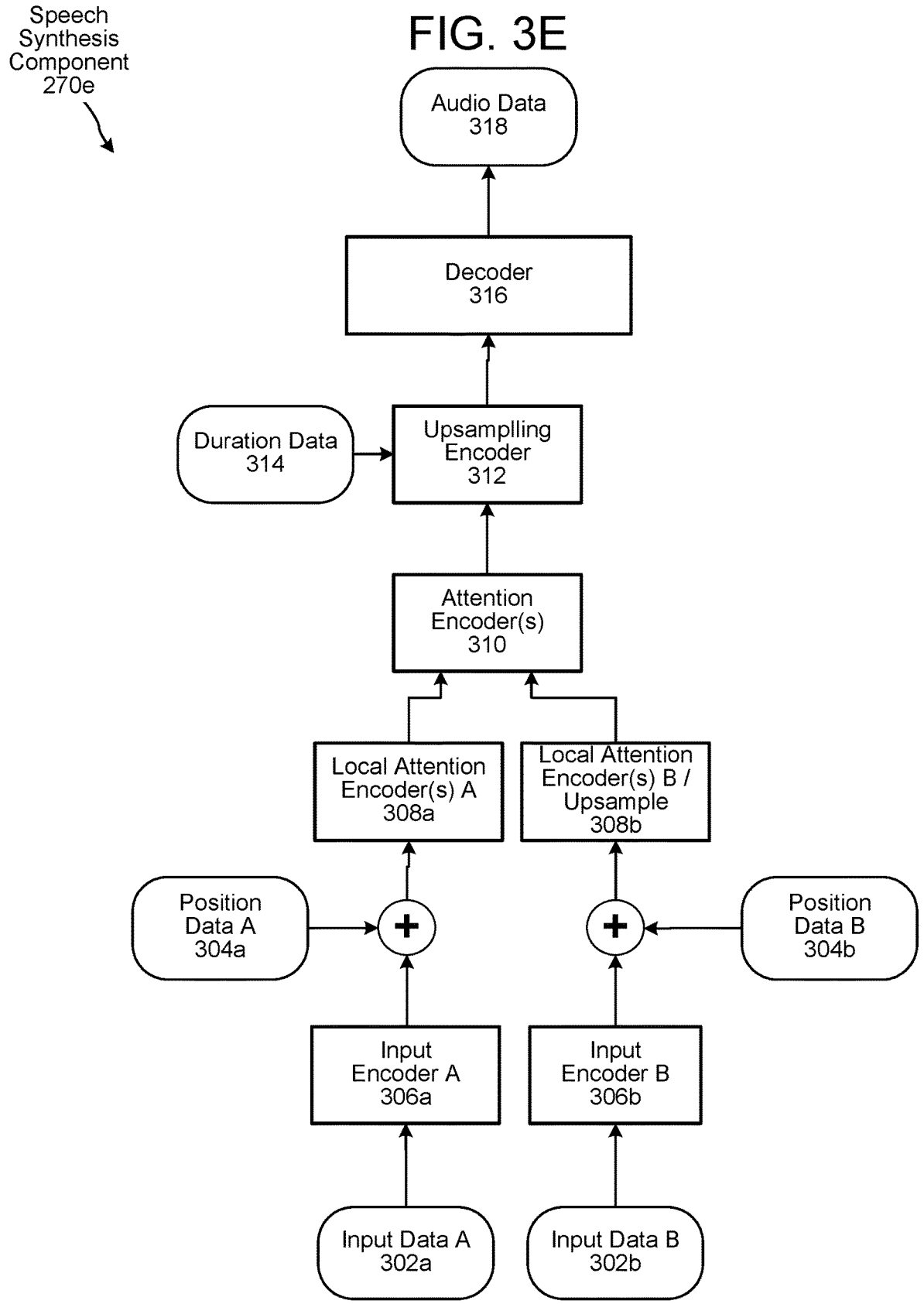
Figure 3F:
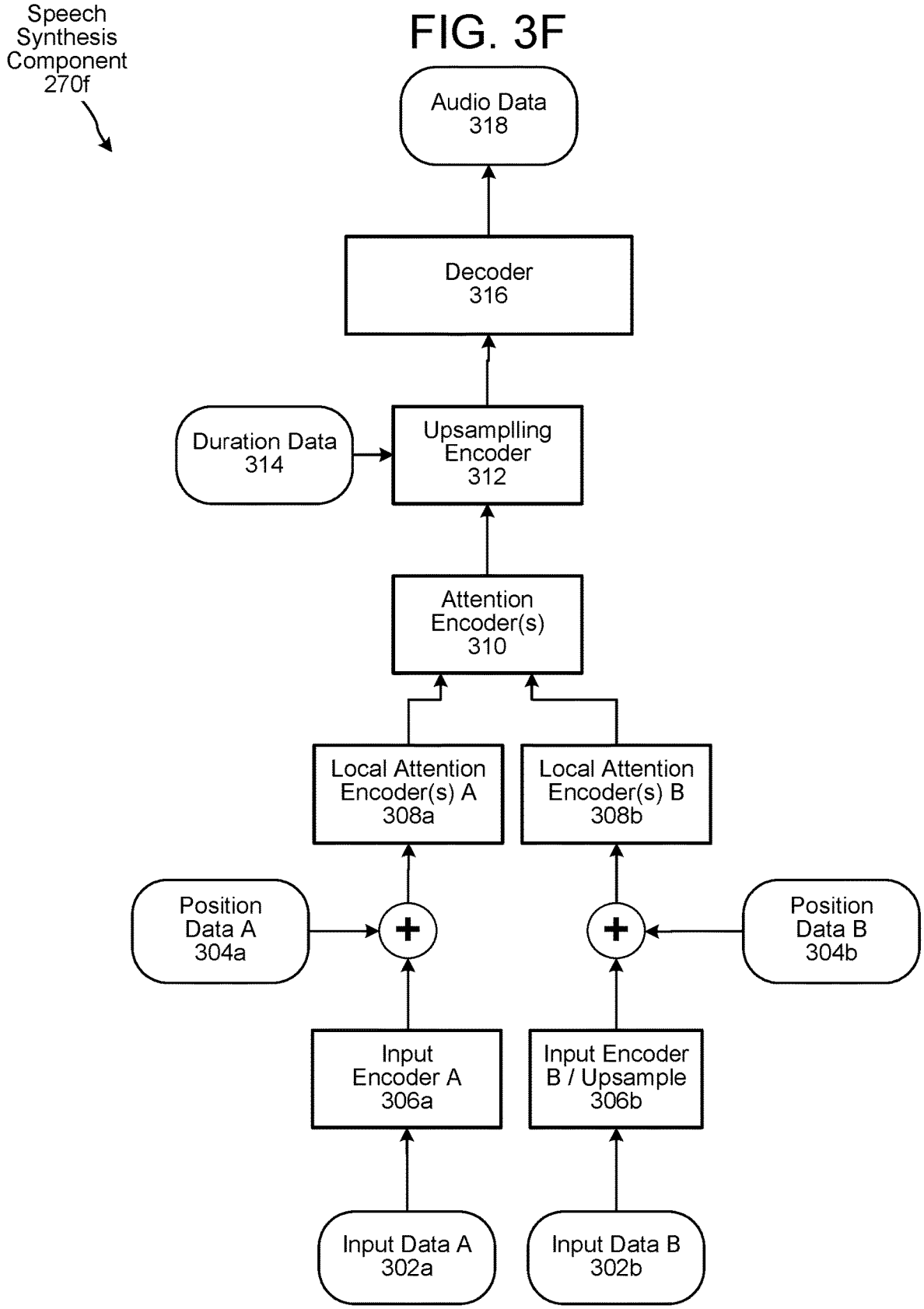
Figure 3G:
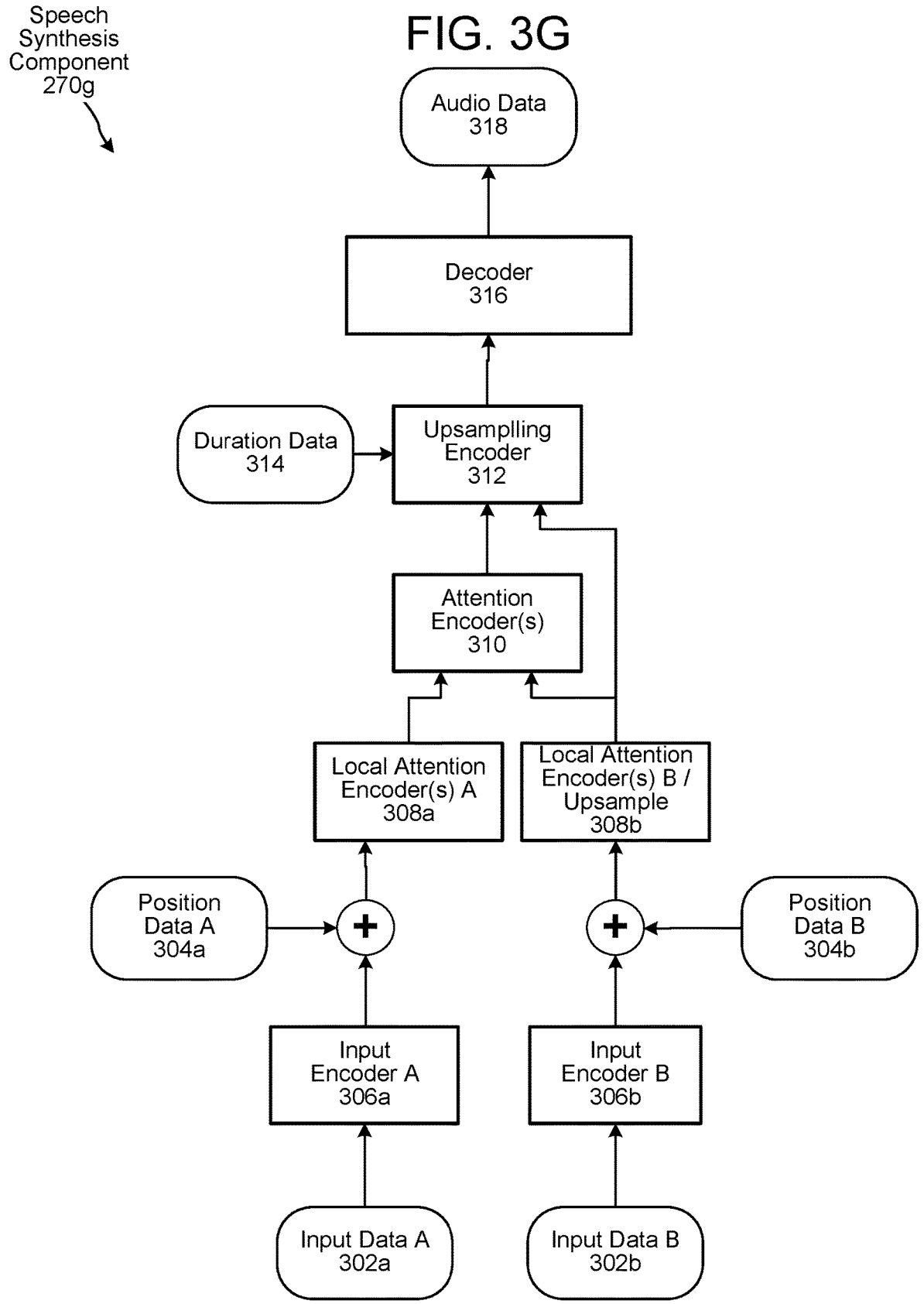

Referring to FIG. 3E, a speech-synthesis component 270*e* may include a single attention encoder 310, which may process the output of a first local attention encoder A 308*a* and a second local attention encoder B 308*b*, the output of which may be upsampled to match the higher frame rate of the output of the first local attention encoder A 308*a*. Referring to FIG. 3F, a similar speech-synthesis component 270*f* may perform the upsampling on the output of the input encoder B 306*b*. Referring to FIG. 3G, the upsampling encoder 312 may receive both the output of the attention encoder 310 and of one or more local attention encoders 308*b*. The remainder of the components may process data in accordance with similar components described above with reference to FIGS. 3A-3D.

FIG. 4 illustrates a local attention encoder 308 and/or an attention encoder 310 (which may be referred to as transformers) according to embodiments of the present disclosure. The encoders 308/310 may include a multi-head attention component 404, a first addition/normalization component A 406, feed-forward and/or convolutional layer(s) 408, and/or a second addition/normalization component B 410. Collectively, these components may be referred to as a transformer; other types of encoders, such as CNN- or RNN-based encoders, are within the scope of the present disclosure.

The multi-head attention component 404 may process each item of encoder input data 402 (which may be the first or second embedding data, described above) in parallel to produce M different outputs; each of the M outputs may be referred to as a "head" of the attention component 404, and when M>1 the attention component 404 may be referred to as a multi-head attention component. Further details of the attention component 404 are described below with reference to FIG. 5A (illustrating an embodiment of the attention component of the attention encoder 310) and with reference to FIG. 5B (illustrating an embodiment of the attention component of the local attention encoder 308).

A first addition/normalization component A 406 may receive the output of the attention component 404 and, in some embodiments, one or more skip connections corresponding to the encoder input data 402. The first normalization component A 406 may perform an addition, tan h, sigmoid, or other such function.

One or more feed-forward and/or convolutional layers 408 may process the output of the first normalization component A 504. The feed-forward and/or convolutional layers 408 may contain one or more layers of one or more nodes, each of which may perform a convolutional scaling, offset, or similar operation on its input data. The nodes may be fully connected or less than fully connected.

A second addition/normalization component B 410 may receive the output of the feed-forward layer(s) 408 and, in some embodiments, one or more skip connections corresponding to the output of the first addition/normalization component A 406. The second addition/normalization component B 410 may similarly perform an addition, tan h, sigmoid, or other such function to determine the encoder output data 412.

Figure 5A:
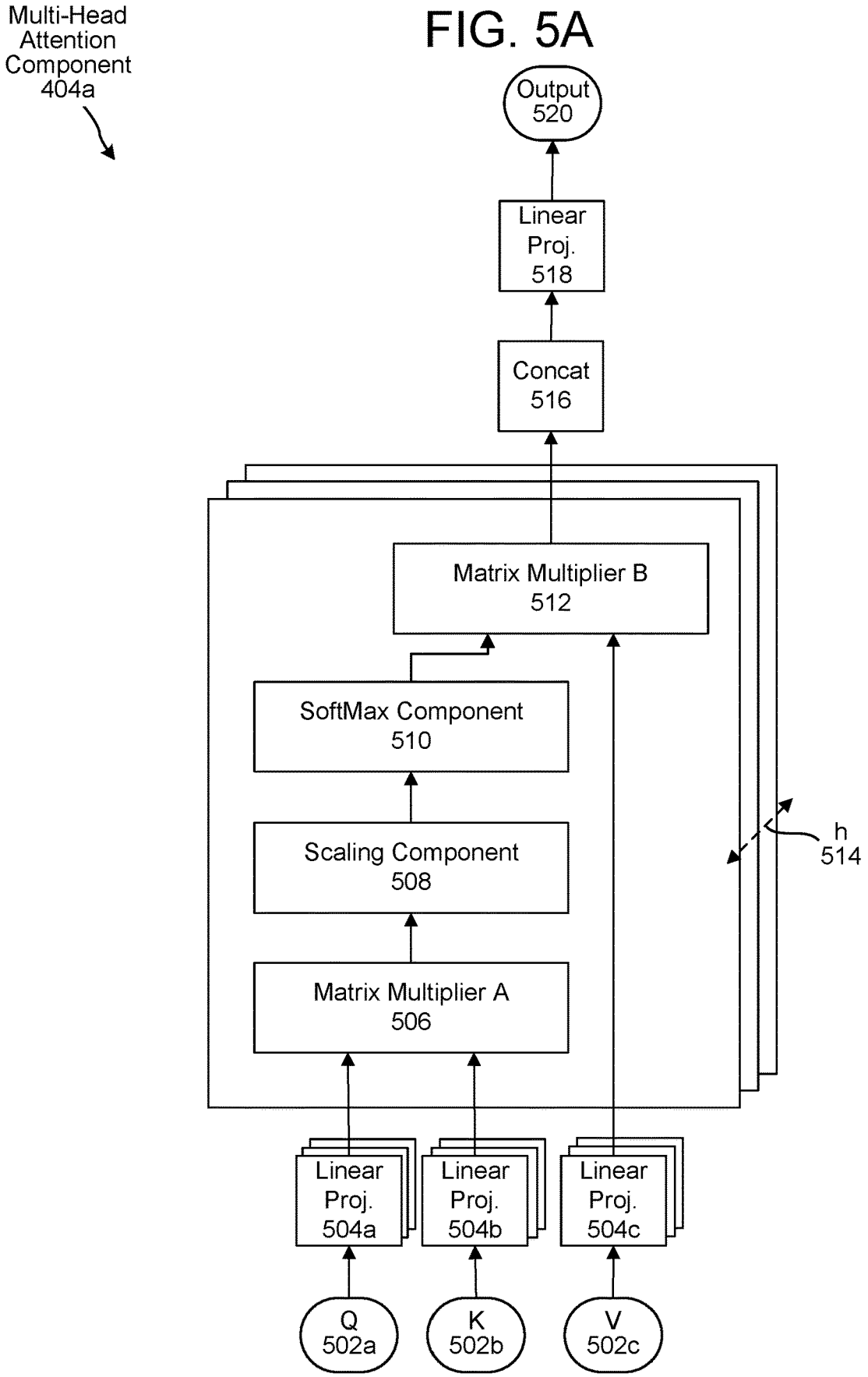
FIGS. 5A and 5B illustrate attention components according to embodiments of the present disclosure.
Figure 5B:
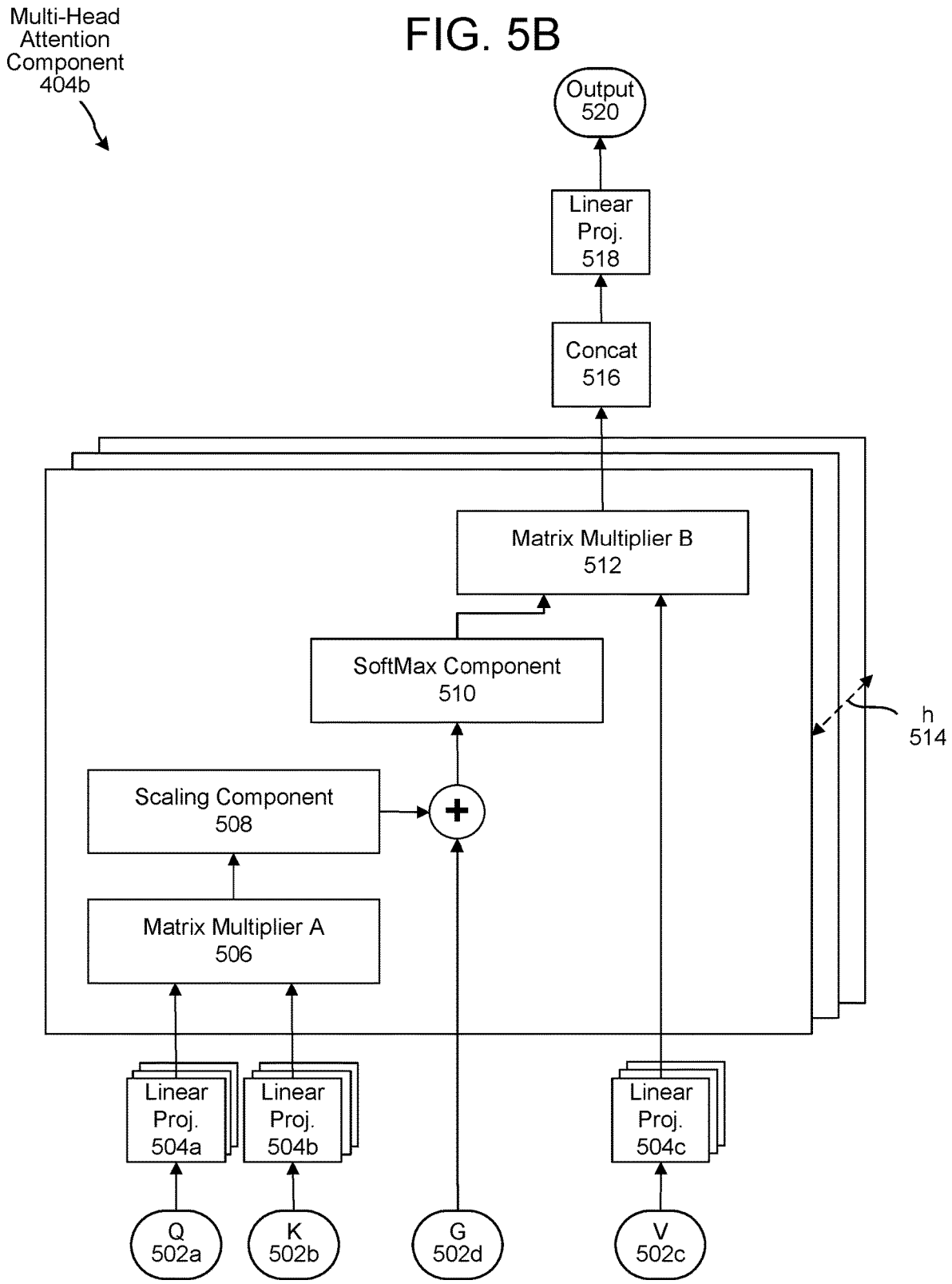

Referring to FIG. 5A, each layer of the multi-head attention component 404*a* (which may correspond to the attention encoder 310) may determine query values Q, key values K, and values V corresponding to the previous layer. The output of that layer may then be given by the below equation (1), in which d refers to the dimension of the previous layer.

$$Attenion(Q, K)V = softmax\left(\frac{QK^T}{\sqrt{d}}\right)V \tag{1}$$

Referring to Equation (1), the value Q 502*a* may be processed by a first linear projection component 504*a*, and the value K 502*b* may be processed by a second linear projection component 504*b*, the outputs of which may be multiplied by a matrix multiplication component A 506. The output of the matrix multiplication component A 506 may be scaled by a scaling component 508, and a softmax component 510 may perform a softmax operation on the output of the scaling component 508. The value V 502*c* may be similarly processed by a third linear projection component 504*c* and multiplied, by a matrix multiplication component B 512.

The multi-head attention component 404*a* may include h 514 instances of the linear projection components 504, the matrix multiplication component A 506, the scaling component 508, the softmax component 510, and the matrix multiplication component B 512. Each output of each instance of the matrix multiplication component B 512 may be referred to as a "head." The various outputs of the various matrix multiplication components B 512 may be concatenated by a concatenation component 516, the output of which may be processed by a linear projection component 518 to determine output data 520. The output data 520 may be the input to the next layer of the multi-head attention component 404*a* or may (for the last layer) be the second embedding data or the third embedding data.

Referring to FIG. 5B, each layer of the multi-head attention component 404*b* (which may correspond to the local-attention encoder 308) may determine a Gaussian distribution G, query values Q, key values K, and values V corresponding to the previous layer. The Gaussian distribution G may correspond to a size of a subset of the data input to the local-attention encoder 308. The output of that layer may then be given by the below equation (2), in which d refers to the dimension of the previous layer.

$$Attenion(Q, K)V = softmax\left(\frac{QK^T}{\sqrt{d}} + G\right)V \tag{2}$$

Figure 6A:
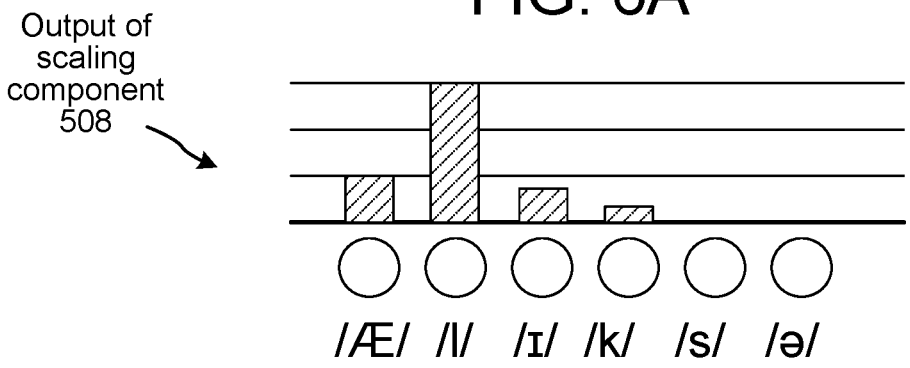
FIGS. 6A-6C illustrate applying attention according to embodiments of the present disclosure.
Figure 6B:
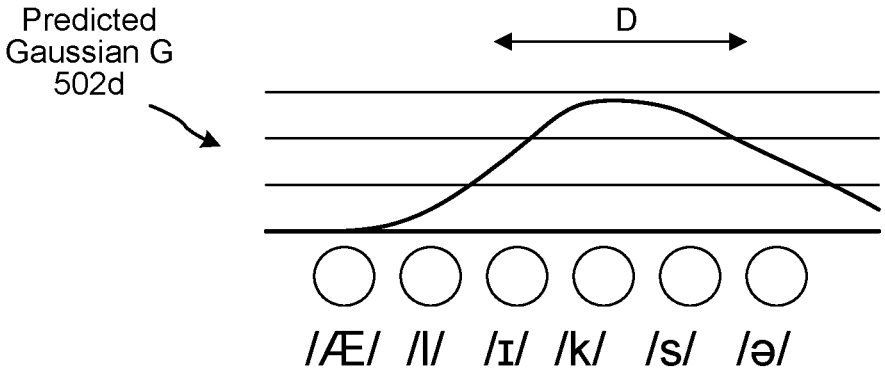
Figure 6C:
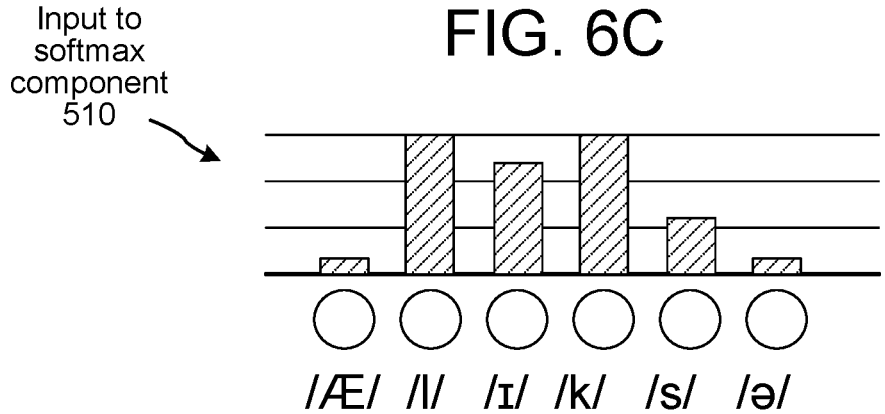

The output of the scaling component 508 (an example of which is shown in FIG. 6A) may thus be combined with the predicted Gaussian G 502*d* (an example of which is shown in FIG. 6B) and processed as an input ((an example of which is shown in FIG. 6C) by the softmax component 510. The Gaussian $G_{i,j}$ represents the relationship between a word $x_j$ in the input data 302 and its predicted central position $P_i$, as shown below in Equation (3), wherein the window size $D_i=2\sigma_i$, and wherein $\alpha$ is the standard deviation of the Gaussian G. The window size $D_i$ may represent the size of the subset of the input data.

$$G_{i,j} = -\frac{(j - P_i)^2}{2\sigma_i^2} \tag{3}$$

The predicted central position P1, and the window size $D_i$ may be defined in accordance with Equation (4).

$$\begin{bmatrix} P_i \\ D_i \end{bmatrix} = I \cdot \text{sigmoid}\left(\begin{bmatrix} p_i \\ z_i \end{bmatrix}\right) \tag{4}$$

In Equation (4), I is a scale factor used to normalize $P_i$ and $D_i$ to values between 0 and the length of the input data 302. The scalar $p_i$ may be found using a feed-forward network configured in accordance with Equation (5).

$$p_i = U_p^T \tan h(W_p Q_i) \tag{5}$$

In Equation (5), $U_p$ is a linear projection, and $W_p$ is the network parameter. The scalar zi may be found using a feed-forward network configured in accordance with Equation (6).

$$z_i = U_d^T \tan h(W_p Q_i) \quad (6)$$

In Equation (6), $U_d$ is a linear projection, and $W_p$ is the network parameter.

Figure 7A:
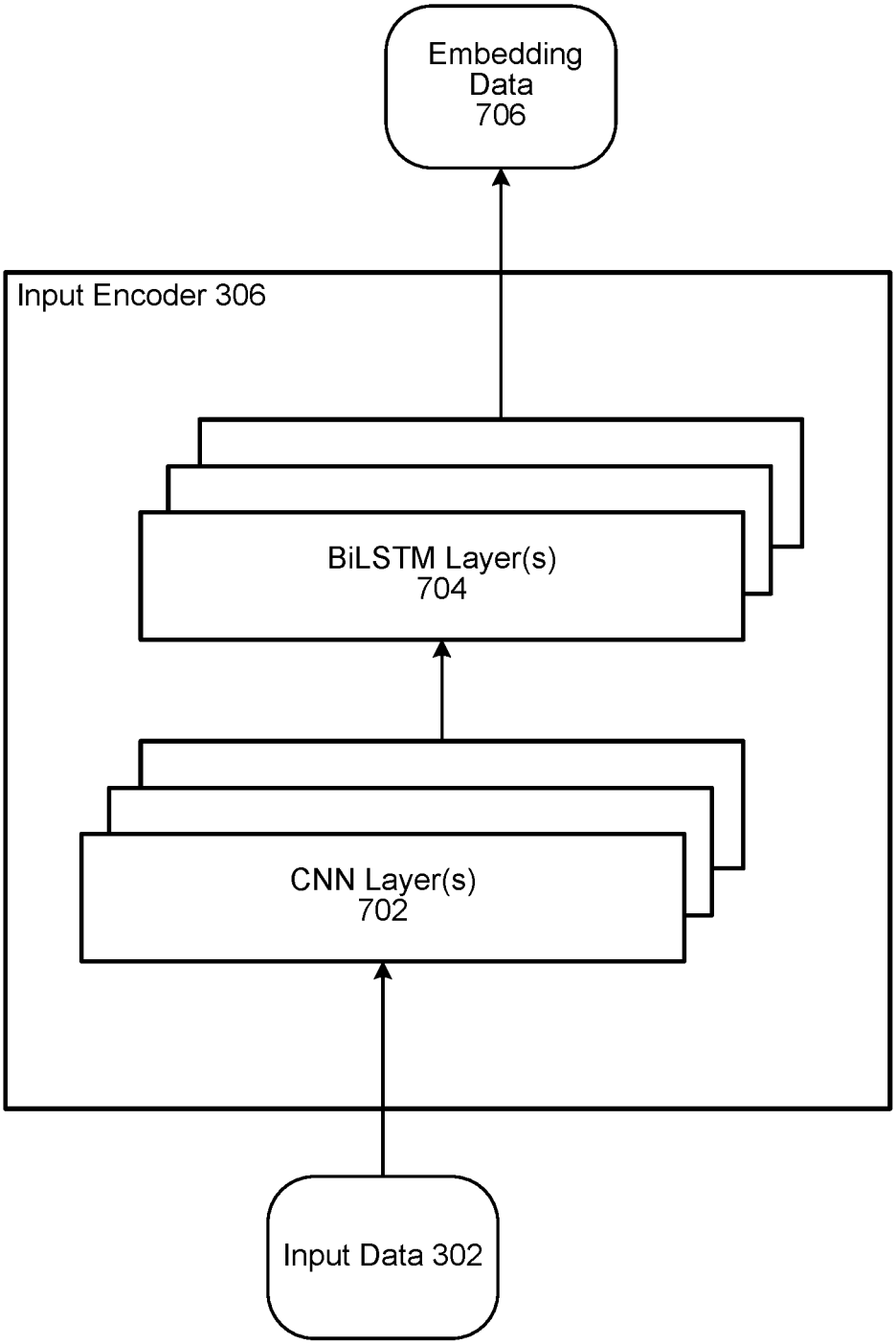
FIG. 7A illustrates components of a second encoder according to embodiments of the present disclosure.

FIG. 7A illustrates components of the input encoder 306 according to embodiments of the present disclosure. One embodiment of the input encoder 306 may include one or more convolutional neural network (CNN) layers 702 for processing input data 302 and one or more uni- or bi-directional long short-term memory (BiLSTM) layers 704 for processing the output(s) of the CNN layers 702 to determine the output embedding data 706. In some embodiments, the encoder 306 includes three CNN layers 702 and one BiLSTM layer 704. The present disclosure is not, however, limited to only these types and numbers of layers, and other deep neural network (DNN) or recurrent neural network (RNN) layers are within its scope.

One embodiment of the encoder 306 may include one or more 2D convolutional neural network (CNN) layers 702 for processing input data (which may be the input data 302) and one or more unidirectional LSTM layers for processing the output(s) of the CNN layers 702.

Figure 7B:
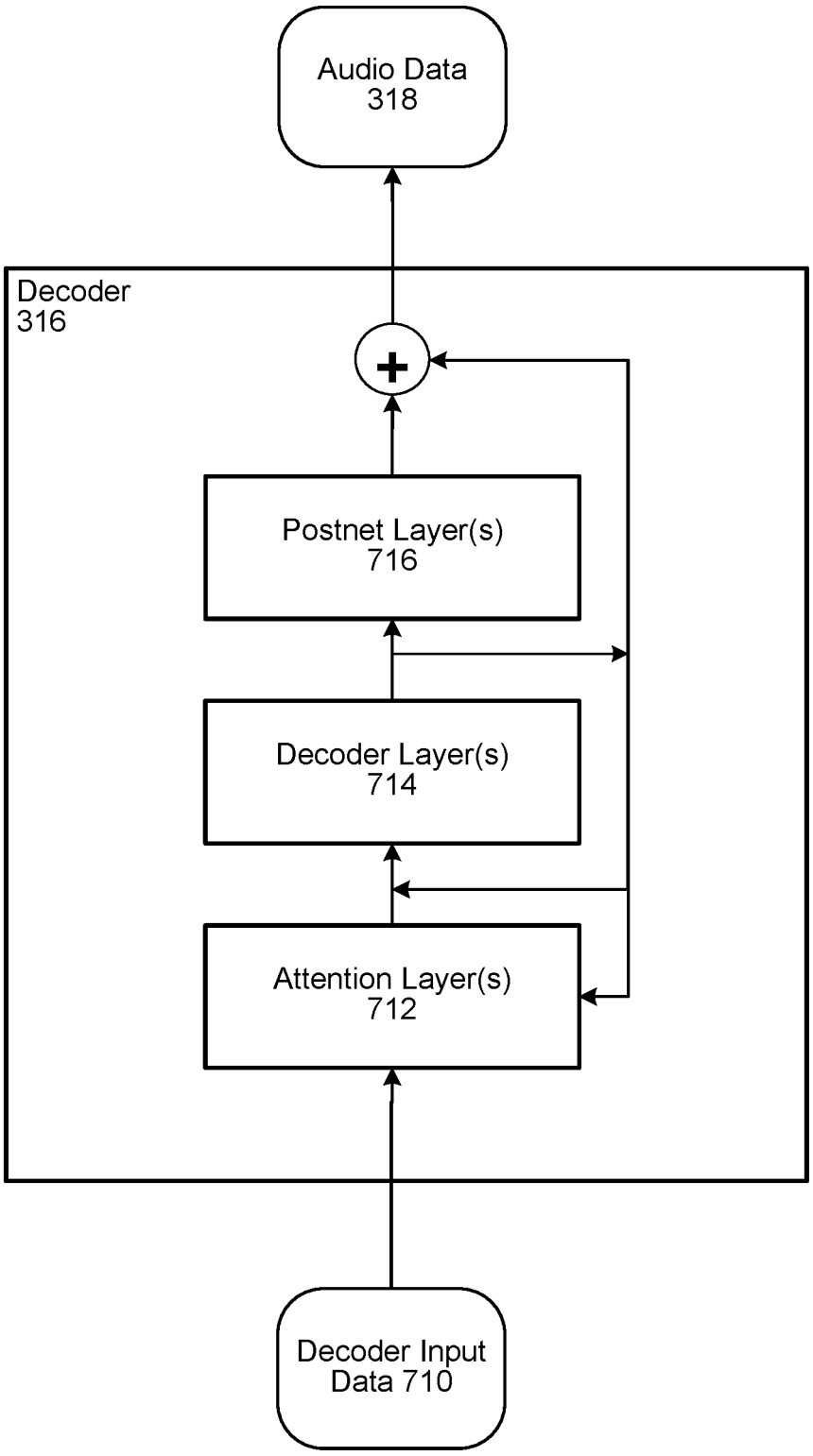
FIG. 7B illustrates components of a decoder according to embodiments of the present disclosure.

FIG. 7B illustrates components of the decoder 316 according to embodiments of the present disclosure. The decoder 316 may include one or more decoder layer(s) 714, which may include one or more LSTM or BiLSTM layers. One or more attention layer(s) 712 may process input data 710, as well as one or more outputs of the decoder layer(s) 714 (e.g., the decoder may be auto-regressive). The attention layer(s) 712 may apply one or more weights to one or more of its inputs to thereby emphasize or "attend to" certain inputs over other inputs. One or more postnet layer(s) 716, such as linear projection, convolutional, and/or activation layers, may process the output(s) of the decoder layer(s) 714 to determine the audio data 318, which may include mel-spectrogram data. A vocoder may process the audio data 318 to determine time-domain audio data.

The decoder layers 714 may include a number of different components according to embodiments of the present disclosure. A BiLSTM layer may process the input data 710. One or more CNN layer(s) may process the outputs of the BiLSTM layers, and one or more LSTM layer(s) may process the output(s) of the CNN layers to determine the audio data 318. In some embodiments, the decoder layers 714 include one BiLSTM layer, three CNN layers, and three LSTM layers. In some embodiments, the output of the LSTM layer(s) is further processed by a postnet layer, which may include linear projection, convolutional, or activation layers, to determine the audio data 318. The decoder layers 714 may correspond to a non-autoregressive decoder, in which the audio data 318 is determined by processing the input data 710. In other embodiments, the decoder layers 714 may correspond to an autoregressive decoder, in which the audio data 318 is determined by processing the input data 710 and at least one previously determined item of audio data 318 (in other words, the output data is determined based at least in part on previously generated output data). Any type of decoder 316, including autoregressive and non-autoregressive decoders, is within the scope of the present disclosure.

Figure 8:
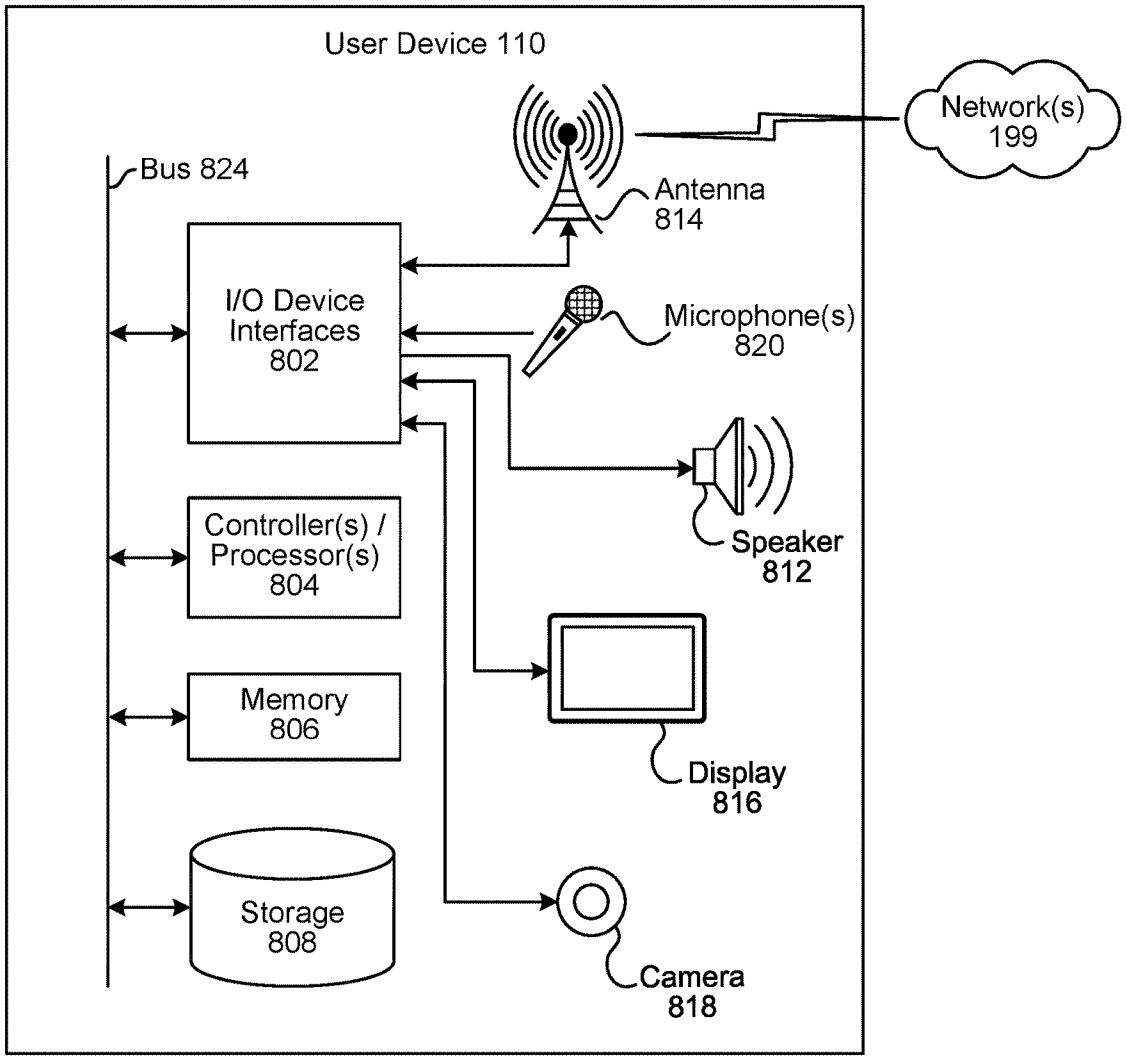
FIG. 8 illustrates components of a user device for speech processing according to embodiments of the present disclosure.
Figure 9:
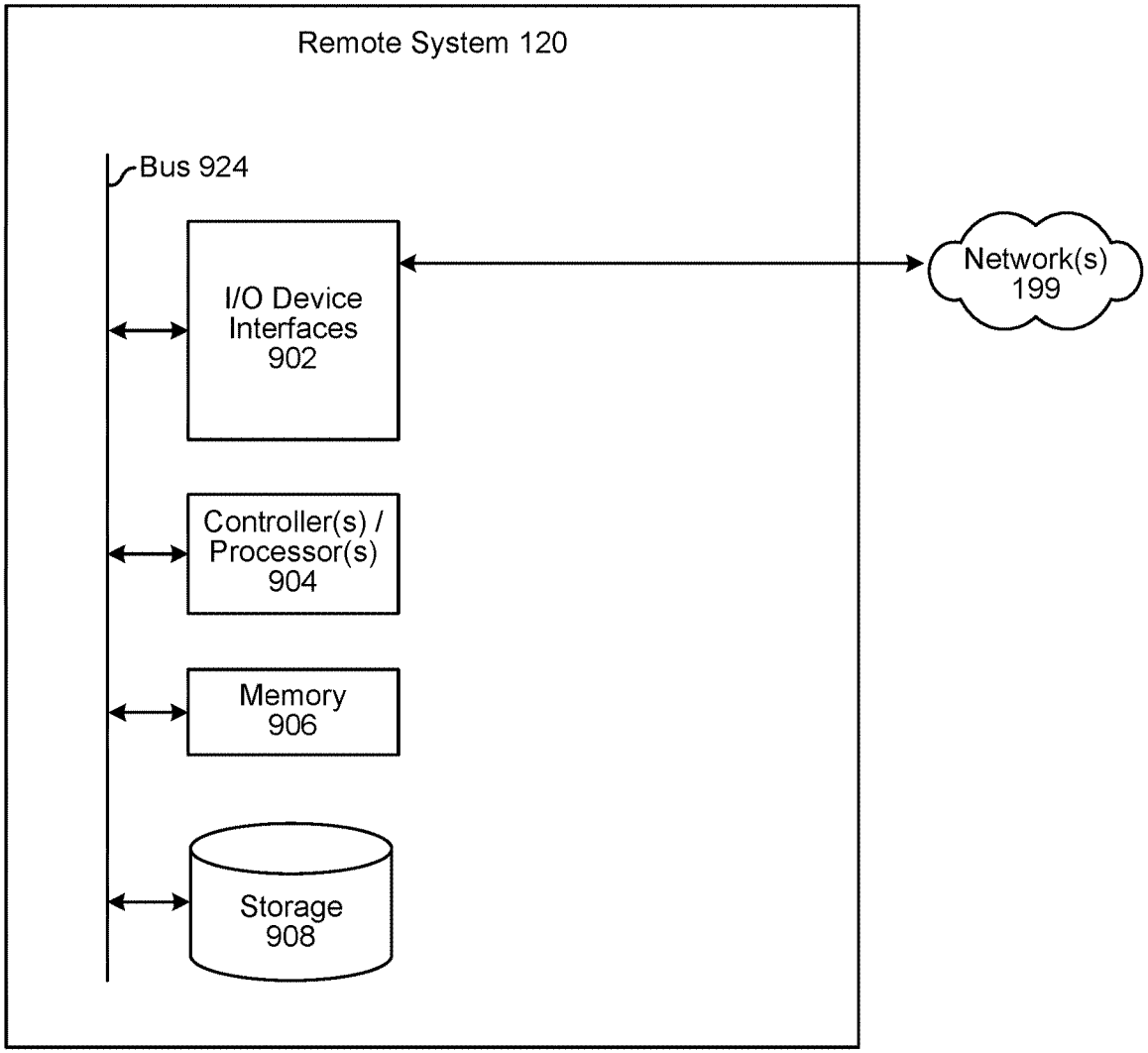
FIG. 9 illustrates components of a remote system for speech processing according to embodiments of the present disclosure.

FIG. 8 is a block diagram conceptually illustrating a user device 110. FIG. 9 is a block diagram conceptually illustrating example components of the remote system 120, which may be one or more servers and which may assist with voice-transfer processing, speech-synthesis processing, NLU processing, etc. The term "system" as used herein may refer to a traditional system as understood in a system/client computing structure but may also refer to a number of different computing components that may assist with the operations discussed herein. For example, a server may include one or more physical computing components (such as a rack system) that are connected to other devices/components either physically or over a network and is capable of performing computing operations. A server may also include one or more virtual machines that emulates a computer system and is run on one or across multiple devices. A server may also include other combinations of hardware, software, firmware, or the like to perform operations discussed herein. The server may be configured to operate using one or more of a client-system model, a computer bureau model, grid computing techniques, fog computing techniques, mainframe techniques, utility computing techniques, a peer-to-peer model, sandbox techniques, or other computing techniques.

Multiple servers may be included in the system 120, such as one or more servers for performing speech processing. In operation, each of these server (or groups of devices) may include computer-readable and computer-executable instructions that reside on the respective server, as will be discussed further below. Each of these devices/systems (110/120) may include one or more controllers/processors (804/904), which may each include a central processing unit (CPU) for processing data and computer-readable instructions, and a memory (806/906) for storing data and instructions of the respective device. The memories (806/906) may individually include volatile random access memory (RAM), non-volatile read only memory (ROM), non-volatile magnetoresistive memory (MRAM), or other types of memory. Each device (110/120) may also include a data storage component (808/908) for storing data and controller/processor-executable instructions. Each data storage component (808/908) may individually include one or more non-volatile storage types such as magnetic storage, optical storage, solid-state storage, etc. Each device (110/120) may also be connected to removable or external non-volatile memory or storage (such as a removable memory card, memory key drive, networked storage, etc.) through respective input/output device interfaces (802/902). The device 110 may further include loudspeaker(s) 812, microphone(s) 820, display(s) 816, or camera(s) 818.

Computer instructions for operating each device/system (110/120) and its various components may be executed by the respective device's controller(s)/processor(s) (804/904), using the memory (806/906) as temporary "working" storage at runtime. A device's computer instructions may be stored in a non-transitory manner in non-volatile memory (806/906), storage (808/908), or an external device(s). Alternatively, some or all of the executable instructions may be embedded in hardware or firmware on the respective device in addition to or instead of software.

Each device/system (110/120) includes input/output device interfaces (802/902). A variety of components may be connected through the input/output device interfaces (802/902), as will be discussed further below. Additionally, each device (110/120) may include an address/data bus (824/924) for conveying data among components of the respective device. Each component within a device (110/120) may also be directly connected to other components in addition to (or instead of) being connected to other components across the bus (824/924).

Figure 10:
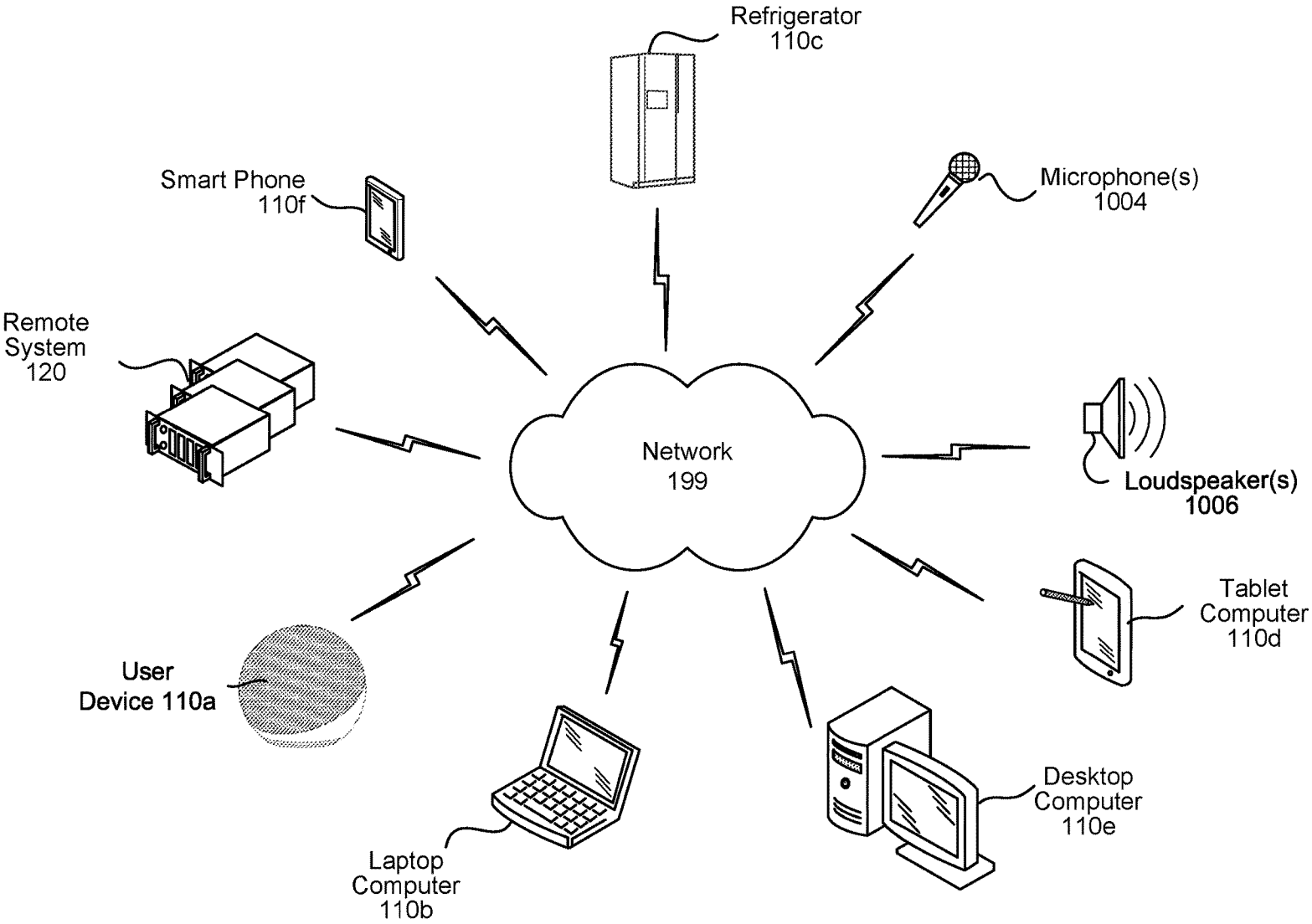
FIG. 10 illustrates a networked computing environment according to embodiments of the present disclosure.

Referring to FIG. 10, the device 110 may include input/output device interfaces 802 that connect to a variety of components such as an audio output component (e.g., a microphone 1004 or a loudspeaker 1006), a wired headset, or a wireless headset (not illustrated), or other component capable of outputting audio. The device 110 may also include an audio capture component. The audio capture component may be, for example, the microphone 820 or array of microphones, a wired headset, or a wireless headset, etc. If an array of microphones is included, approximate distance to a sound's point of origin may be determined by acoustic localization based on time and amplitude differences between sounds captured by different microphones of the array. The device 110 may additionally include a display for displaying content. The device 110 may further include a camera.

Via antenna(s) 814, the input/output device interfaces 802 may connect to one or more networks 199 via a wireless local area network (WLAN) (such as WiFi) radio, Bluetooth, or wireless network radio, such as a radio capable of communication with a wireless communication network such as a Long Term Evolution (LTE) network, WiMAX network, 3G network, 4G network, 5G network, etc. A wired connection such as Ethernet may also be supported. Through the network(s) 199, the system may be distributed across a networked environment. The I/O device interface (802/902) may also include communication components that allow data to be exchanged between devices such as different physical systems in a collection of systems or other components.

The components of the device(s) 110 or the system 120 may include their own dedicated processors, memory, or storage. Alternatively, one or more of the components of the device(s) 110 or the system 120 may utilize the I/O interfaces (802/902), processor(s) (804/904), memory (806/906), or storage (808/908) of the device(s) 110 or system 120.

As noted above, multiple devices may be employed in a single system. In such a multi-device system, each of the devices may include different components for performing different aspects of the system's processing. The multiple devices may include overlapping components. The components of the device 110 or the system 120, as described herein, are illustrative, and may be located as a stand-alone device or may be included, in whole or in part, as a component of a larger device or system.

The network 199 may further connect a voice-controlled user device 110*a*, a tablet computer 110*d*, a smart phone 110*f*, a refrigerator 110*c*, a desktop computer 110*e*, or a laptop computer 110*b* through a wireless service provider, over a WiFi or cellular network connection, or the like. Other devices may be included as network-connected support devices, such as a system 120. The support devices may connect to the network 199 through a wired connection or wireless connection. Networked devices 110 may capture audio using one-or-more built-in or connected microphones or audio-capture devices, with processing performed by components of the same device or another device connected via network 199. The concepts disclosed herein may be applied within a number of different devices and computer systems, including, for example, general-purpose computing systems, speech processing systems, and distributed computing environments.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of computers and speech processing should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage media may be implemented by a volatile computer memory, non-volatile computer memory, hard drive, solid-state memory, flash drive, removable disk or other media. In addition, components of one or more of the components and engines may be implemented as in firmware or hardware, such as the acoustic front end, which comprise among other things, analog or digital filters (e.g., filters configured as firmware to a digital signal processor (DSP)).

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements or steps. Thus, such conditional language is not generally intended to imply that features, elements, or steps are in any way required for one or more embodiments or that one or more embodiments necessarily include logic for deciding, with or without other input or prompting, whether these features, elements, or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is understood with the context as used in general to present that an item, term, etc., may be either X, Y, or Z, or any combination thereof (e.g., X, Y, or Z). Thus, such disjunctive language is not generally intended to, and should not, imply that certain embodiments require at least one of X, at least one of Y, or at least one of Z to each be present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method for generating synthesized speech, the method comprising:

receiving first data corresponding to phonemes representing synthesized speech to be output;

processing, using a first encoder, the first data to determine first embedding data;

determining, using a local attention transformer component, a first Gaussian distribution corresponding to a first subset of the first embedding data;

processing, using the local attention transformer component, the first Gaussian distribution and the first subset to determine second embedding data;

determining, using the local attention transformer component, a second Gaussian distribution corresponding to a second subset of the first embedding data;

processing, using the local attention transformer component, the second Gaussian distribution and the second subset to determine third embedding data;

processing, using a transformer component, the second embedding data and the third embedding data to determine fourth embedding data;

upsampling, using a second encoder and duration data corresponding to an upsampling rate, the fourth embedding data to determine upsampled fourth embedding data having a first sampling rate greater than a second sampling rate of the third embedding data; and processing, using a decoder, the upsampled fourth embedding data to determine audio data representing the synthesized speech.

2. The computer-implemented method of claim 1, further comprising:

receiving second data corresponding to words representing the synthesized speech;

processing, using a third encoder, the second data to determine fifth embedding data; and upsampling, using a fourth encoder and second duration data, the fifth embedding data to determine upsampled fifth embedding data, wherein the audio data is further based on the upsampled fifth embedding data.

3. A computer-implemented method comprising:

processing, using a first encoder, input data to determine first embedding data representing speech to be synthesized;

determining, using a first attention component of a second encoder, second data representing a size of a subset of the first embedding data;

processing, using the first attention component, the first embedding data and the second data to determine second embedding data;

processing, using a second attention component of a third encoder, at least the second embedding data to determine third embedding data; and processing the third embedding data to determine audio data corresponding to the speech.

4. The computer-implemented method of claim 3, further comprising:

processing, using a fourth encoder, second input data to determine fourth embedding data, wherein the audio data is further based at least in part on the fourth embedding data, and wherein the input data corresponds to a first level of hierarchy and the second input data corresponds to a second level of hierarchy.

5. The computer-implemented method of claim 3, further comprising:

processing, using a fourth encoder, second input data to determine fourth embedding data representing the speech;

determining, using a third attention component, third data representing a second size of a second subset of the fourth embedding data, wherein the second size represents a standard deviation of a distribution corresponding to the second subset;

processing, using the third attention component, the fourth embedding data and the third data to determine fifth embedding data; and processing, using a fourth attention component, at least the fifth embedding data to determine sixth embedding data, wherein the audio data is further based at least in part on the sixth embedding data, and wherein the input data corresponds to a first level of hierarchy and the second input data corresponds to a second level of hierarchy.

6. The computer-implemented method of claim 3, further comprising:

processing, using a fourth encoder, second input data to determine fourth embedding data representing the speech, wherein the second data further represents a size of a subset of the fourth embedding data, wherein the second embedding data is further based at least in part on the fourth embedding data, and wherein the input data corresponds to a first level of hierarchy and the second input data corresponds to a second level of hierarchy.

7. The computer-implemented method of claim 3, further comprising:

processing, using a fourth encoder, second input data to determine fourth embedding data representing the speech;

determining, using a third attention component of a fifth encoder, third data representing a second size of a second subset of the fourth embedding data; and processing, using the third attention component, the fourth embedding data and the third data to determine fifth embedding data, wherein the third embedding data is further based at least in part on the fifth embedding data, and wherein the input data corresponds to a first level of hierarchy and the second input data corresponds to a second level of hierarchy.

8. The computer-implemented method of claim 7, wherein processing the third embedding data comprises:

upsampling, using duration data, the third embedding data and the fifth embedding data to determine upsampled embedding data; and processing, using a decoder, the upsampled embedding data.

9. The computer-implemented method of claim 3, wherein processing the third embedding data comprises:

upsampling, using duration data, the third embedding data to determine upsampled third embedding data; and processing, using a decoder, the upsampled third embedding data.

10. The computer-implemented method of claim 3, wherein:

determining the second data comprises determining a Gaussian distribution, wherein a standard deviation of the Gaussian distribution corresponds to the size.

11. The computer-implemented method of claim 3, wherein determining the first embedding data comprises performing at least one convolution.

12. A system comprising:

at least one processor; and at least one memory including instructions that, when executed by the at least one processor, cause the system to:

process, using a first encoder, input data to determine first embedding data representing speech to be synthesized;

determine, using a first attention component of a second encoder, second data representing a size of a subset of the first embedding data;

process, using the first attention component, the first embedding data and the second data to determine second embedding data;

process, using a second attention component of a third encoder, at least the second embedding data to determine third embedding data; and process the third embedding data to determine audio data corresponding to the speech.

13. The system of claim 12, wherein the at least one memory includes further instructions that, when executed by the at least one processor, further cause the system to:

process, using a fourth encoder, second input data to determine fourth embedding data, wherein the audio data is further based at least in part on the fourth embedding data, and wherein the input data corresponds to a first level of hierarchy and the second input data corresponds to a second level of hierarchy.

14. The system of claim 12, wherein the at least one memory includes further instructions that, when executed by the at least one processor, further cause the system to:

process, using a fourth encoder, second input data to determine fourth embedding data representing the speech;

determine, using a third attention component, third data representing a second size of a second subset of the fourth embedding data, wherein the second size represents a standard deviation of a distribution corresponding to the second subset;

process, using the third attention component, the fourth embedding data and the third data to determine fifth embedding data; and process, using a fourth attention component, at least the fifth embedding data to determine sixth embedding data, wherein the audio data is further based at least in part on the sixth embedding data, and wherein the input data corresponds to a first level of hierarchy and the second input data corresponds to a second level of hierarchy.

15. The system of claim 12, wherein the at least one memory includes further instructions that, when executed by the at least one processor, further cause the system to:

process, using a fourth encoder, second input data to determine fourth embedding data representing the speech, wherein the second data further represents a size of a subset of the fourth embedding data, wherein the second embedding data is further based at least in part on the fourth embedding data, and wherein the input data corresponds to a first level of hierarchy and the second input data corresponds to a second level of hierarchy.

16. The system of claim 12, wherein the at least one memory includes further instructions that, when executed by the at least one processor, further cause the system to:

process, using a fourth encoder, second input data to determine fourth embedding data representing the speech;

determine, using a third attention component of a fifth encoder, third data representing a second size of a second subset of the fourth embedding data; and process, using the third attention component, the fourth embedding data and the third data to determine fifth embedding data, wherein the third embedding data is further based at least in part on the fifth embedding data, and wherein the input data corresponds to a first level of hierarchy and the second input data corresponds to a second level of hierarchy.

17. The system of claim 16, wherein the at least one memory includes further instructions that, when executed by the at least one processor, further cause the system to:

upsample, using duration data, the third embedding data and the fifth embedding data to determine upsampled embedding data; and process, using a decoder, the upsampled embedding data.

18. The system of claim 12, wherein the at least one memory includes further instructions for processing the third embedding data that, when executed by the at least one processor, further cause the system to:

upsample, using duration data, the third embedding data to determine upsampled third embedding data; and process, using a decoder, the upsampled third embedding data.

19. The system of claim 12, wherein the at least one memory includes further instructions that, when executed by the at least one processor, further cause the system to:

determine the second data comprises determining a Gaussian distribution, wherein a standard deviation of the Gaussian distribution corresponds to the size.

20. The system of claim 12, wherein the instructions that cause the system to determine the first embedding data comprise instructions for performing at least one convolution.

* * * * *